US012708823B2

(12) United States Patent
Poirier et al.

(10) Patent No.: US 12,708,823 B2
(45) Date of Patent: Aug. 18, 2026

(54) GOLF BAG WITH TOP CUFF

(71) Applicant: Acushnet Company, Fairhaven, MA (US)

(72) Inventors: Brian R. Poirier, Portsmouth, RI (US); Paul Robinson, Plainville, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/969,465

(22) Filed: Dec. 5, 2024

(65) Prior Publication Data

US 2025/0121269 A1 Apr. 17, 2025

Related U.S. Application Data

(63) Continuation-in-part of application No. 18/898,937, filed on Sep. 27, 2024, which is a continuation-in-part of application No. 18/131,947, filed on Apr. 7, 2023, now Pat. No. 12,343,607.

(51) Int. Cl.
*A63B 55/40* (2015.01)

(52) U.S. Cl.
CPC ..... *A63B 55/40* (2015.10)

(58) Field of Classification Search
CPC ..... A63B 55/40; A63B 55/406; A63B 55/408
USPC ..... 206/315.2, 315.3, 315.47, 315.5, 315.6, 206/315.7, 315.8
See application file for complete search history.

(56) References Cited

U.S. PATENT DOCUMENTS

| | | | | |
|---|---|---|---|---|
| 2,435,479 | A | 2/1948 | Thommen | |
| 4,266,589 | A | 5/1981 | Cochran | |
| 4,378,039 | A | 3/1983 | Suk | |
| 4,691,823 | A | 9/1987 | Pape | |
| 5,482,160 | A | 1/1996 | Perrin | |
| 5,638,954 | A | 6/1997 | Hsien | |
| 5,769,220 | A | 6/1998 | Hong | |
| 5,788,071 | A | 8/1998 | Shiao | |
| 5,918,737 | A | 7/1999 | Kwon | |
| 5,941,383 | A | 8/1999 | Cheng | |
| 5,984,095 | A | 11/1999 | Kim | |
| 6,047,822 | A | 4/2000 | Batten | |
| 6,510,944 | B2 * | 1/2003 | Chang | A63B 55/00 206/315.6 |
| 6,595,357 | B2 * | 7/2003 | Sutter | A63B 55/00 206/315.6 |
| 6,598,743 | B1 | 7/2003 | Puskaric | |

(Continued)

FOREIGN PATENT DOCUMENTS

| | | |
|---|---|---|
| CN | 112791362 | 5/2021 |
| CN | 107115645 | 7/2022 |

(Continued)

*Primary Examiner* — Ernesto A Grano

(57) ABSTRACT

A golf bag comprising a bag body with a top opening, a closed bottom, and one or more body panels extending between the top opening and the closed bottom to form a partially enclosed region within the bag body for storing golf equipment; a top cuff arranged along the top opening; and a lining that is extendable around and over the top cuff, wherein a portion of the lining is folded over the top cuff and secured to an inner surface of the top cuff, wherein the one or more body panels comprise (i) a first portion that is directly secured to the inner surface of the top cuff and (ii) a second portion that is indirectly secured to the inner surface of the top cuff.

20 Claims, 24 Drawing Sheets

(56) References Cited

U.S. PATENT DOCUMENTS

| | | | | |
|---|---|---|---|---|
| 6,935,496 | B2 | 8/2005 | Chang et al. | |
| 7,090,075 | B1 | 8/2006 | Rocha | |
| 7,216,762 | B2 | 5/2007 | Chen | |
| 8,141,705 | B2 | 3/2012 | Aubery | |
| 8,757,373 | B2 | 6/2014 | Aubery | |
| 9,314,679 | B2 * | 4/2016 | Engel | A63B 55/40 |
| 9,586,109 | B2 | 3/2017 | Martell | |
| 9,662,553 | B2 | 5/2017 | Cheng | |
| 9,789,373 | B2 | 10/2017 | Cheng | |
| 9,931,554 | B2 * | 4/2018 | Marquez | A63B 55/50 |
| 10,173,112 | B2 | 1/2019 | Martell | |
| 11,123,616 | B2 | 9/2021 | Martell | |
| 11,911,673 | B2 | 2/2024 | Martell | |
| 2002/0096444 | A1 | 7/2002 | Chang | |
| 2006/0108243 | A1 | 5/2006 | Tan | |
| 2006/0272967 | A1 | 12/2006 | Bremner | |
| 2007/0138040 | A1 | 6/2007 | Chan | |
| 2011/0303568 | A1 | 12/2011 | Reimers | |
| 2013/0075290 | A1 | 3/2013 | Chang | |
| 2013/0213837 | A1 | 8/2013 | Suk | |
| 2014/0034528 | A1 | 2/2014 | Anderson | |
| 2016/0346652 | A1 | 12/2016 | Wang | |
| 2017/0014692 | A1 * | 1/2017 | Dolezel | A63B 55/40 |
| 2022/0184476 | A1 | 6/2022 | Zhang | |

FOREIGN PATENT DOCUMENTS

| | | |
|---|---|---|
| CN | 217339995 | 9/2022 |
| CN | 218129853 | 12/2022 |

* cited by examiner

GOLF BAG WITH TOP CUFF

CROSS REFERENCE

This application is a Continuation-in-Part of U.S. patent application Ser. No. 18/898,937 filed on Sep. 27, 2024, which is a Continuation-in-Part of U.S. patent application Ser. No. 18/131,947 filed on Apr. 7, 2023, each of which is incorporated herein by reference in its entirety for all purposes.

BACKGROUND

Golf bags can be used to hold or carry golf equipment including golf clubs or balls, as well as accessories such as head covers, apparel, brushes and/or towels, umbrellas, golf tees, scorecards, writing utensils, and/or range finders. In some cases, golfers may walk a golf course and carry their golf bags. In other cases, golfers may use a push cart or a trolley. Alternatively, golfers may use a golf cart to transport their golf equipment around a golf course. In some cases, golf bags may be designed for different modes of transportation in order to accommodate the various needs and/or preferences of golfers.

SUMMARY

The present disclosure provides various examples and embodiments of golf bags comprising a top cuff with an exposed front panel. The exposed front panel may not or need not comprise any fabric or other textile material covering the front panel. The golf bags of the present disclosure may be universally compatible with golf bag holding mechanisms (e.g., a bag retention or securement mechanism that is attachable to or integrated with a golf cart or a golf push cart or trolley). The exposed front panel of the presently disclosed golf bags may extend downward from the top opening of the top cuff towards a knuckle bracket (e.g., a separately provided knuckle bracket that is fastened to the top cuff or an integrated knuckle bracket that is integrally formed with the rest of the top cuff) having knuckles for engaging with one or more legs. The exposed front panel may provide a support surface that is positioned to contact a golf bag holding mechanism (or any portion or component thereof). The support surface of the exposed front panel may comprise a rigid material that is wear-resistant and does not experience accelerated physical or aesthetic degradation (e.g., discoloring) like other conventional golf bags with a fabric or textile covered front panel that directly contacts portions or components of bag holding mechanisms.

The present disclosure provides additional examples and embodiments of golf bags comprising a top cuff and a knuckle bracket (e.g., a separately provided knuckle bracket that is attachable to the top cuff or an integrated knuckle bracket that is integrally formed with one or more other portions of the top cuff), one or more body panels, a lining, and a front liner piece. The knuckle bracket and the corresponding knuckles may be positioned at one or more predetermined distance(s) from the closed bottom of the golf bag and/or the top cuff so that the knuckles and the legs of the bag do not directly contact a securement mechanism of a bag holding mechanism. The knuckle bracket, the knuckles, and the legs of the bag may be positioned to allow the exposed front panel to directly contact the securement member of the bag holding mechanism. The knuckle bracket, knuckles, and legs of the bag may be positioned to minimize or prevent any intervening or interfering physical interactions with the bag holding mechanism which might prevent a flush contact between the support surface of the exposed front panel and the securement mechanism of the bag holding mechanism. The positioning of the knuckle bracket, knuckles, and legs may not negatively impact or otherwise compromise (i) the stability of the legs when deployed or (ii) a retractability of the legs for transport or storage.

In one aspect, the present disclosure provides examples and embodiments of golf bags comprising (i) one or more body panels and (ii) a lining that wrap over or around the top cuff of the golf bags. In some cases, the one or more body panels may extend around or over the lining that wrap over or around the top cuff. In some cases, the one or more body panels may be secured directly to (i) the lining and/or (ii) an inner surface of the top cuff. The body panels and the lining may comprise separate components or pieces with different material properties. The golf bags disclosed herein may comprise a body panel that extends continuously from the bottom of the bag to the top of the top cuff. The body panel may be secured to the golf bag without using any externally visible fasteners since the body panels can be wrapped over the top cuff and directly affixed to an inner surface of the top cuff or a lining that is already affixed to the inner surface of the top cuff. In some cases, the body panels of the golf bag can be wrapped around or over the top cuff in tension and directly or indirectly secured to the top cuff, thereby minimizing the number of fasteners used to construct the golf bag. In some cases, the golf bags disclosed herein may be assembled using fewer fasteners compared to other conventional golf bags without compromising the structural integrity or aesthetics of the golf bag. In some cases, the golf bags of the present disclosure may be fabricated or manufactured without needing to utilize a secondary cuff panel.

In another aspect, the present disclosure provides examples and embodiments of golf bags comprising a lining and a separate front liner piece. The lining may wrap around or over the top cuff of the golf bag. In some cases, the lining may be configured to provide a protective layer or cover to minimize wear or damage to the top cuff material and/or any clubs placed in a compartment formed by the dividers of the top cuff. The separate front liner piece may interface with a slot, channel, or opening provided along an inner surface of the top cuff (e.g., by wrapping around or over a wall or an edge of the slot, channel, or opening). In some cases, the front liner piece may be configured to provide a protective layer or cover at or near a top front portion of the top cuff (e.g., to minimize wear or damage to the top cuff material and/or any clubs placed in a compartment adjacent to the top front portion of the top cuff). In some cases, the front liner piece may be configured to provide a protective layer or cover between a golfer's equipment and the top cuff material without interfering with or covering the exposed front panel of the top cuff.

In another aspect, the present disclosure provides a golf bag comprising: a body comprising an opening, a closed bottom, and one or more body panels; a top cuff attached to the opening, the top cuff comprising a first member extending along one or more sides of the top cuff and a second member extending above or below the first member; and a lining configured to extend around or over the first member of the top cuff. In some embodiments, the lining is secured to an inner surface of the top cuff. In some embodiments, the one or more body panels are configured to extend around or over the second member of the top cuff and directly couple to a portion of the lining secured to the inner surface of the top cuff.

In some embodiments, the one or more body panels are releasably coupled to the portion of the lining secured to the inner surface of the top cuff. In some embodiments, the one or more body panels overlap the portion of the lining secured to the inner surface of the top cuff. In some embodiments, the one or more body panels comprise at least one panel that extends continuously from the closed bottom to the second member of the top cuff. In some embodiments, the one or more body panels and the lining extend over or around a same portion or section of the top cuff.

In some embodiments, the top cuff comprises an exposed front panel configured to contact or interface with a bag holding mechanism. In some embodiments, the one or more body panels do not cover or overlap the exposed front panel.

In some embodiments, the first and second members extend between a front portion and a back portion of the top cuff. In some embodiments, the first member and the second member are disposed at different heights or different distances from the opening of the body.

In some embodiments, the top cuff further comprises one or more apertures, windows, or openings formed between the first member and the second member. In some cases, the lining is configured to extend through the one or more apertures, windows, or openings. In some cases, the one or more body panels are configured to extend across the one or more apertures, windows, or openings.

In some embodiments, the golf bag may further comprise a knuckle bracket configured to interface with one or more legs for supporting the golf bag. In some embodiments, the knuckle bracket and the top cuff may comprise separate components that are not integrally formed. In other embodiments, the knuckle bracket and the top cuff may be integrally formed as a single unitary one-piece assembly.

In some embodiments, a portion of the one or more body panels is disposed between the knuckle bracket and a lower portion of the top cuff. In some embodiments, the one or more body panels do not cover or overlap the knuckle bracket or an upper portion of the top cuff. In some embodiments, the one or more body panels extend along or under an upper portion of the top cuff. In some embodiments, the upper portion of the top cuff extends further out or away from a front side of the top cuff than the lower portion of the top cuff. In some embodiments, the knuckle bracket is positioned (i) along the lower portion of the top cuff and (ii) under the upper portion of the top cuff.

In some embodiments, the golf bag may further comprise one or more fasteners for securing the lining or the one or more body panels to the top cuff. In some embodiments, the golf bag may further comprise one or more tabs for securing the lining or the one or more body panels to the top cuff. In some embodiments, the golf bag may further comprise one or more fasteners and one or more tabs for securing the lining or the one or more body panels to the top cuff.

In some embodiments, the golf bag may further comprise a channel slot extending along a portion of the inner surface of the top cuff. In some embodiments, the lining comprises one or more integrated tabs insertable into the channel slot to secure the lining to the inner surface of the top cuff.

In some embodiments, the golf bag may further comprise a front liner piece that is separate from the lining and independently securable to the top cuff. In some embodiments, the front liner piece does not cover or overlap an exposed front panel of the top cuff. In some embodiments, the exposed front panel may be configured to contact or interface with a bag holding mechanism.

In some embodiments, the front liner piece comprises one or more integrated tabs insertable into the channel slot to secure the front liner piece to the inner surface of the top cuff. In some embodiments, the front liner piece comprises a support board and a foam material. In some embodiments, the front liner piece is configured to wrap over onto itself. In some embodiments, a first portion of the front liner piece is attachable to a second portion of the front liner piece. In some embodiments, the front liner piece and/or the one or more body panels comprise one or more integrated tabs that are (i) insertable into the channel slot from a bottom of the channel slot and (ii) configured to extend upwards into the channel slot from the bottom of the channel slot to secure the front liner piece and/or the one or more body panels to the top cuff.

In some embodiments, the golf bag may further comprise at least one fastener for securing the front liner piece to a front portion of the top cuff. In some embodiments, the at least one fastener is configured to secure a knuckle bracket and the one or more body panels to the front portion of the top cuff.

In some embodiments, the one or more body panels comprise (i) a first body panel and a second body panel extending along opposite sides of the top cuff and (ii) a rear body panel positioned between the first and second body panels. In some embodiments, a distance between an edge of the first body panel and an edge of the second body panel is equal to a width of a bottom portion of the rear body panel. In some embodiments, a first portion of the one or more body panels is positioned between the top cuff and a knuckle bracket of the golf bag. In some embodiments, a second portion of the one or more body panels is wrapped around the top cuff.

In some embodiments, the top cuff comprises at least one divider terminating at a channel slot disposed along the inner surface of the top cuff. In some embodiments, the top cuff comprises one or more dividers terminating directly at the inner surface of the top cuff. In some embodiments, the top cuff comprises one or more dividers extending directly to or from the inner surface of the top cuff. In some embodiments, the top cuff comprises at least one divider that does not extend directly to or from the inner surface of the top cuff. In some embodiments, the lining of the golf bag comprises a plurality of independently adjustable lining flaps configured to wrap around the top cuff and at least one divider of the top cuff.

In another aspect, the present disclosure provides a golf bag comprising a bag body with a top opening, a closed bottom, and one or more body panels extending between the top opening and the closed bottom to form a partially enclosed region within the bag body for storing golf equipment; a top cuff arranged along the top opening; and a lining that is extendable around and over the top cuff. In some embodiments, a portion of the lining may be folded over the top cuff and secured to an inner surface of the top cuff. In some embodiments, the one or more body panels may comprise (i) a first portion that is directly secured to the inner surface of the top cuff and (ii) a second portion that is indirectly secured to the inner surface of the top cuff. In some embodiments, the lining and the one or more body panels may be secured along different portions of the inner surface of the top cuff.

In some embodiments, the top cuff may comprise an upper member and a lower member extending along a side of the top cuff. In some embodiments, the lining may be configured to extend around and over a lower member of the top cuff. In some embodiments, the one or more body panels may be configured to extend around and over an upper member of the top cuff.

In some embodiments, the top cuff may comprise a window or an aperture formed between the upper member and the lower member. In some embodiments, the first portion may be configured to extend through the window or the aperture. In some embodiments, the second portion may be configured to extend around and over an upper edge of the top cuff. In some embodiments, the second portion may be secured to the first portion. In some embodiments, the first portion may be configured to indirectly secure the second portion to the inner surface of the top cuff. In some embodiments, the first portion may be configured to extend around and over an upper edge of the top cuff. In some embodiments, the second portion may be configured to extend through the window or the aperture. In some embodiments, the second portion may be secured to the first portion. In some embodiments, the first portion may be configured to indirectly secure the second portion to the inner surface of the top cuff.

In some embodiments, the first portion and the second portion may be configured to overlap a same portion of the inner surface of the top cuff. In some embodiments, the first portion and the second portion may be configured to overlap different portions of the inner surface of the top cuff.

In some embodiments, the first portion may comprise a first set of extensions configured to extend around one or more dividers of the golf bag. In some embodiments, the second portion may comprise a second set of extensions configured to extend around the one or more dividers of the golf bag. In some embodiments, the first set of extensions and the second set of extensions may be configured to extend around a same divider of the golf bag.

In some embodiments, the golf bag may further comprise a separate front liner piece. In some embodiments, the separate front liner piece may be offset from an upper front side edge of the top cuff.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Non-limiting and non-exhaustive examples and embodiments of the present disclosure are described with reference to the following figures.

DETAILED DESCRIPTION

The present disclosure will now be described more fully in reference to the accompanying figures, in which various non-limiting embodiments are shown.

It shall be understood that when an element is referred to as being "attached," "coupled" or "connected" to another element, it can be directly attached, coupled or connected to the other element (with or without any intervening elements). In contrast, when an element is referred to as being "directly attached," directly coupled" or "directly connected" to another element, there may not or need not be any intervening elements present.

It is noted that any one or more aspects or features described with respect to one embodiment may be incorporated in various other different embodiments. That is, any embodiments and/or features of any embodiments can be combined in any way and/or in any order with any other embodiments and/or any other features of any embodiments, without limitation. Applicant reserves the right to modify any originally filed claim or file any new claim(s) accordingly, including the right to amend any originally filed claim to depend from and/or incorporate any feature of any other claim. Various non-limiting aspects and features of the present disclosure are provided in further detail in the specification set forth below.

Overview

In one aspect, the present disclosure provides various non-limiting examples and embodiments of a golf bag. In some cases, the golf bag may comprise a body. In some cases, the golf bag may comprise a top cuff attached to the body. In some cases, the golf bag may comprise a knuckle bracket (e.g., a separate knuckle bracket configured to interface with the top cuff, or a knuckle bracket that is integrally formed with the top cuff). In some cases, the golf bag may comprise one or more body panels. In some cases, the golf bag may comprise a lining and/or a separate front liner piece.

Figure 1:
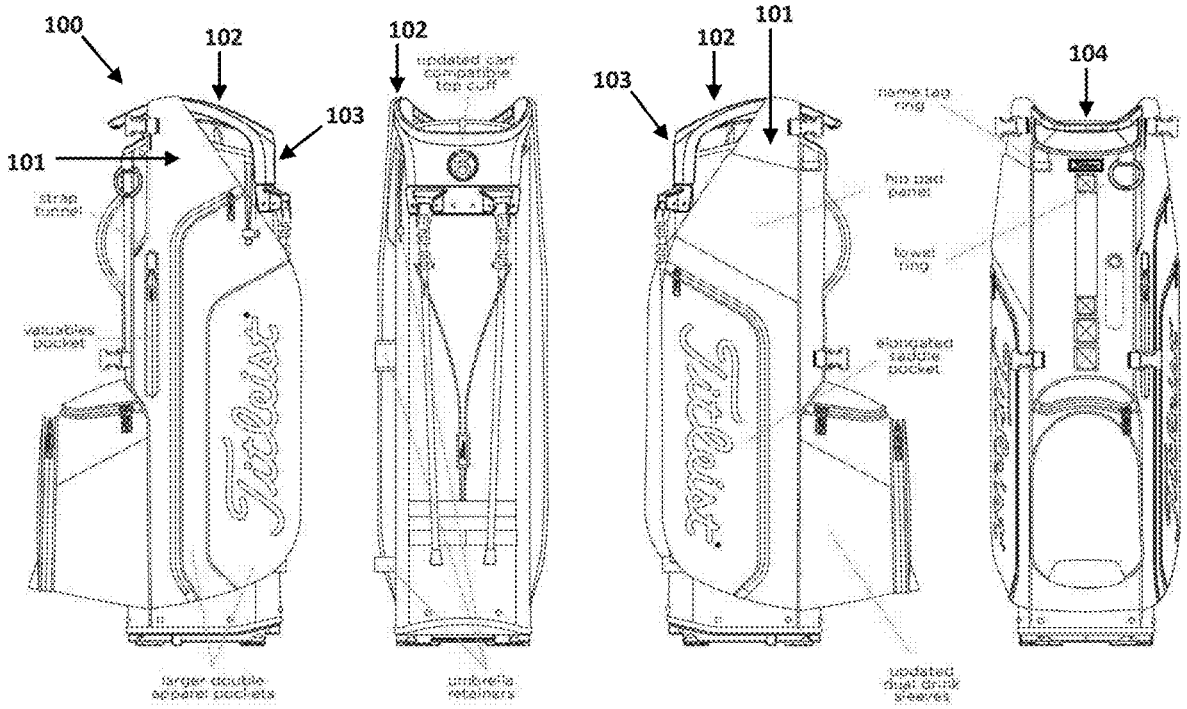
FIGS. 1 and 2 schematically illustrate an exemplary golf bag comprising a top cuff, in accordance with some embodiments.
Figure 2:
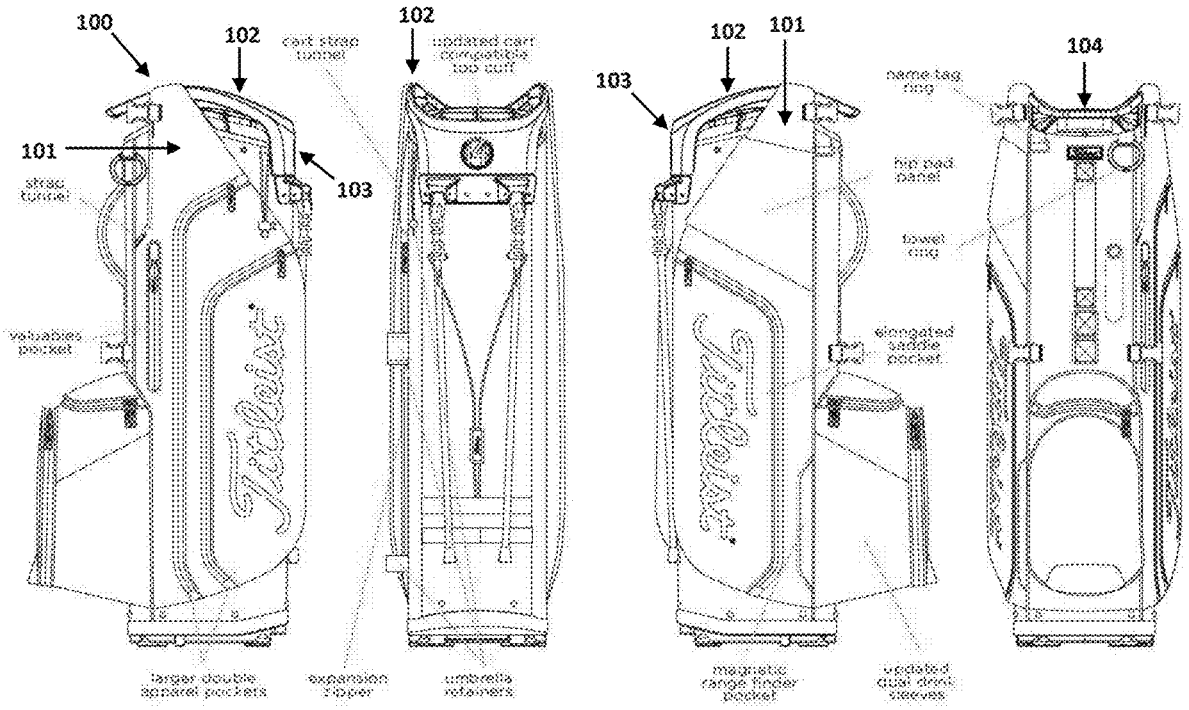

FIGS. 1 and 2 schematically illustrate an exemplary golf bag 100. The golf bag 100 may include one or more body panels 101 and a top cuff 102. The top cuff 102 may extend around the top opening of the golf bag 100. In some cases, the top cuff 102 may have a front portion 103 that includes an exposed front panel. In some cases, the top cuff 102 may have a rear portion 104 that includes an integrated handle. In some cases, the top cuff 102 may have a plurality of members that extend along the sides of the golf bag between the front portion 103 and the rear portion 104.

In some cases, the one or more body panels 101 may include one or more hip panels extending along a left and/or right side of the golf bag 100. In some cases, the one or more body panels 101 may include a front body panel extending along a front side of the golf bag 100. In some cases, the one or more body panels 101 may include a back body panel extending along a rear or back side of the golf bag 100.

In some non-limiting embodiments, the golf bag 100 may include one or more pockets. In some cases, the one or more pockets may include one or more apparel pockets or one or more valuables pockets. In some cases, the one or more pockets may include one or more storage pockets disposed on a rear portion (e.g., a back side or rear panel) of the golf bag. In some cases, the one or more pockets may include a saddle pocket. In some cases, the one or more pockets may include an additional pocket disposed adjacent to the saddle pocket. In some cases, the additional pocket may be configured to house golf-related equipment (e.g., a range finder) . In some cases, the one or more pockets may be opened and/or closed using a fastener. In some cases, the fastener may comprise a magnetic closure. In some cases, the fastener may comprise a sliding fastener. In some cases, the sliding fastener may comprise, for example, a zipper. In other cases, the fastener may comprise a snap closure (e.g., one or more buttons) or a hook and loop fastener (e.g., Velcro).

In some cases, the one or more pockets may include multiple pockets that are attached or directly adjacent to each other. In some cases, the multiple pockets may share a common wall or layer of material. In some cases, a single layer or panel may form one or more walls associated with two or more pockets. In some cases, the multiple pockets may comprise a first pocket and a second pocket. In some cases, the first pocket may be adjacent to but structurally separate from the second pocket. In other cases, the first pocket may be integrated with the second pocket. In some cases, the first pocket may be positioned inside or formed within the second pocket. In other cases, the first pocket may be provided on top of or underneath the second pocket.

In some non-limiting embodiments, the golf bag 100 may include a strap tunnel. The strap tunnel may comprise a channel or a passageway that extends (i) through a portion of the golf bag body or (ii) between two or more layers or components of the golf bag. In some cases, the strap tunnel may be configured to receive a strap for securing the golf bag 100 to a bag holding or retention mechanism. In some cases, the strap tunnel may be accessible via one or more openings located at an entrance or an exit of the channel or passageway. In some cases, the one or more openings may be sized and/or shaped to receive the strap and route the strap into the channel or passageway, through the channel or passageway, or out of the channel or passageway.

In some non-limiting embodiments, the golf bag 100 may include one or more grommets. The grommets may be placed at or near the one or more openings of the strap tunnel. In some cases, the grommets may comprise a piece of material that can line or cover the one or more openings. In some cases, the piece of material may comprise a ring or a strip of material that can line or cover the edges of the one or more openings. In some cases, the grommets may be configured to protect and/or reinforce (i) the openings of the strap tunnel and/or (ii) the material surrounding the openings (i.e., the surrounding material that is cut or pierced in order to form the one or more openings). In some cases, the grommets may be used to prevent tearing or abrasion of the pierced or cut material (e.g., due to friction or abrasion when a strap moves through the one or more openings of the strap tunnel). In some cases, the grommets may be configured to cover one or more sharp edges around the openings to prevent the strap from snagging the one or more sharp edges, and to generally protect the edges from accelerated wear and tear.

In some non-limiting embodiments, the one or more grommets may comprise a compliant or elastic material. In other non-limiting embodiments, the one or more grommets may comprise a rigid or generally inelastic or inextensible material. In some cases, the one or more grommets may comprise a rubber material. In other cases, the one or more grommets may comprise a metal material, an intermetallic material, a composite material, or a plastic material.

In some non-limiting embodiments, the golf bag 100 may include one or more umbrella retainers. The one or more umbrella retainers may be sized and shaped to accommodate one or more umbrellas. The one or more umbrellas may be in a folded configuration and/or a deployed configuration.

In some non-limiting embodiments, the golf bag 100 may include one or more drink sleeves. The one or more drink sleeves may be sized and shaped to accommodate one or more containers containing a consumable. The consumable may be a solid or a liquid substance. In some cases, the one or more drink sleeves may be configured to fix a position and/or an orientation of the one or more containers (e.g., to reduce or minimize movement of the containers and/or to prevent the consumable from spilling or leaking out of the containers).

In some non-limiting embodiments, the golf bag 100 may include one or more rings. In some cases, the one or more rings may include an accessories ring for attaching one or more golf accessories (e.g., a towel or a brush for a golf club). In some cases, the one or more rings may include a name tag ring for affixing a name tag to a portion of the golf bag 100.

Structure

Bag Body

In some embodiments, the golf bag may comprise a body. In some cases, the body may be elongated to accommodate a length of one or more golf clubs or other golf-related equipment. In some cases, the body may include an opening and a closed bottom. The opening may be located at the top of the golf bag body. The opening may be configured to receive the one or more golf clubs. The closed bottom may be configured to support the one or more golf clubs inserted into the body through the opening.

Top Cuff

In some embodiments, the golf bag may comprise a top cuff. In some cases, the top cuff may be attached to the top opening of the golf bag body.

Figure 3A:
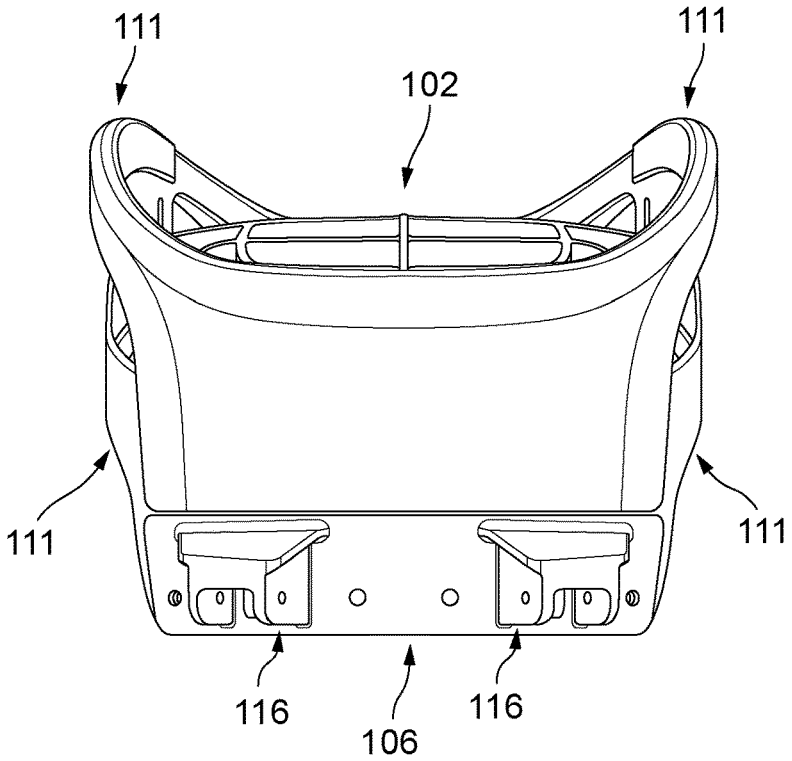
FIGS. 3A and 3B illustrate an exemplary top cuff for a golf bag, in accordance with some embodiments.
Figure 3B:
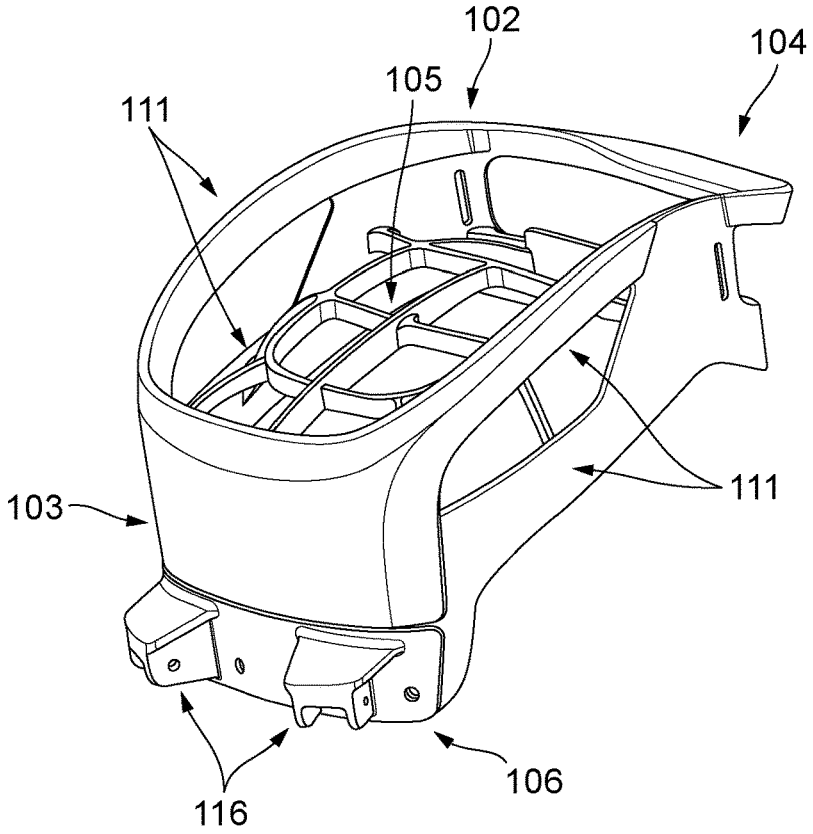

FIGS. 3A and 3B illustrate an example of a top cuff 102 of a golf bag. FIG. 3A shows a front view of the top cuff 102 of the golf bag. FIG. 3B shows a side perspective view of the top cuff 102 of the golf bag. The top cuff 102 may comprise a plurality of dividers 105 that extend across the top opening of the golf bag to form one or more compartments for receiving one or more golf clubs or other golf-related equipment.

In some cases, the top cuff 102 may have a front portion 103 comprising an exposed front panel. The exposed front panel may be positioned above a knuckle bracket 106 that is attachable to the front portion 103 of the top cuff 102. In some cases, the top cuff 102 may have a rear portion 104 comprising an integrated handle. The top cuff 102 may comprise one or more members 111 that extend along the sides of the top cuff 102 between the front portion 103 and the rear portion 104 of the top cuff 102.

In some embodiments, the top cuff may comprise an integrated handle. In some cases, the integrated handle may be provided at a rear portion 104 of the top cuff. In some cases, a front portion 103 of the top cuff may comprise an exposed panel configured to interface with or contact a bag holding mechanism.

In some cases, the front portion 103 of the top cuff may comprise an upper portion and a lower portion. In some cases, the upper portion may be configured to extend further out or away from the one or more members 111 than the lower portion of the top cuff. In some cases, the lower portion may be recessed or depressed relative to the upper portion in order to accommodate a separately provided knuckle bracket (described in greater detail below). In some cases, the top cuff may comprise an integrated knuckle bracket. In some cases, the integrated knuckle bracket may comprise a knuckle bracket that is integrally formed with the lower portion of the top cuff.

Figure 4A:
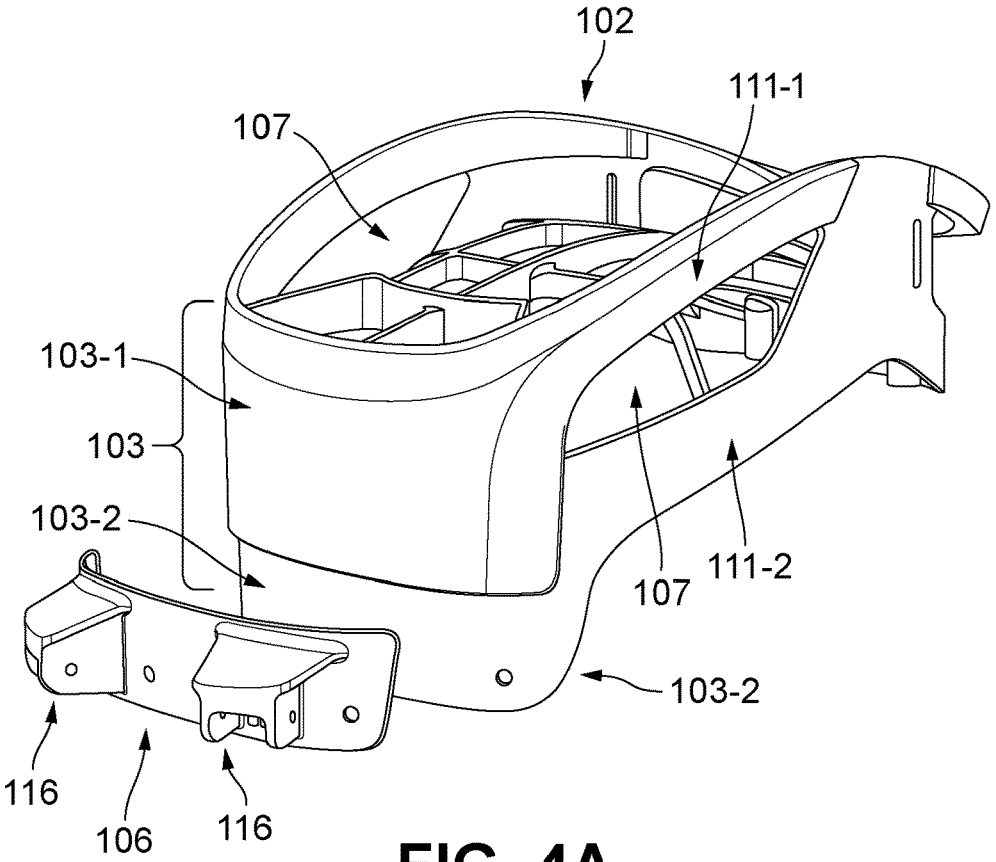
FIGS. 4A and 4B illustrate a top cuff and a knuckle bracket for a golf bag, in accordance with some embodiments.

FIG. 4A schematically illustrates a top cuff 102 comprising a front portion 103 with an upper front portion 103-1 and a lower front portion 103-2. The upper front portion 103-1 may correspond to the exposed front panel of the golf bag. The lower front portion 103-2 may correspond to a portion of the front panel that is configured to (i) interface with a separately provided knuckle bracket 106 or (ii) accommodate a knuckle bracket that is integrally formed with the rest of the top cuff. The lower front portion 103-2 may be sized and shaped to accommodate the size, shape, and curvature of the knuckle bracket 106.

In some embodiments, the lining, the separate front liner piece, and/or the one or more body panels of the golf bag may not or need not extend around or over a front upper portion of the top cuff. In some embodiments, the lining, the separate front liner piece, and/or the one or more body panels do not extend around or over the front upper portion of the top cuff. In some embodiments, the front upper portion may be positioned above a knuckle bracket of the golf bag. In some cases, the front upper portion may be configured to directly contact a component of a bag holding mechanism or a portion thereof. In some cases, the knuckle bracket may be positioned under the region of contact between the exposed front panel and the bag holding mechanism to avoid interfering between the exposed front panel and the bag holding mechanism, so that the exposed front panel of the golf bag can rest flush against the bag holding mechanism.

In some embodiments, the top cuff may comprise one or more members extending between the integrated handle and the exposed front panel. In some cases, the top cuff may comprise a first member 111-1 that the one or more body panels extend around or over. In some cases, the top cuff may comprise a second member 111-2 that the lining extends around or over. In some cases, the first member 111-1 and the second member 111-2 may extend along the sides of the top cuff (e.g., between the exposed front panel and the integrated handle). In some cases, the first and second members may be configured to extend between a front portion and a rear portion of the top cuff. In some cases, the first member 111-1 may correspond to an upper member of the top cuff that forms an uppermost part of the golf bag. In some cases, the second member 111-2 may correspond to a lower member of the top cuff. In some cases, the lower member may extend under or may be positioned below the upper member. In some cases, the upper member may extend over or may be positioned above the lower member.

In some embodiments, the lining for the top cuff may extend around or over the lower member. In other non-limiting embodiments, the lining may extend around or over the upper member. In some alternative embodiments, the lining may extend around or over the lower member and/or the upper member.

In some embodiments, the one or more body panels of the golf bag may extend around or over the upper member. In other embodiments, the one or more body panels may extend around or over the lower member. In some alternative embodiments, the one or more body panels may extend around or over the upper member and/or the lower member.

In some embodiments, the top cuff may comprise a plurality of members extending between the front and rear portions of the top cuff. The plurality of members may extend along the sides of the top cuff. In some cases, the plurality of members may comprise a first member 111-1 and a second member 111-2. In some cases, the first and second members may be disposed at different heights relative to each other, or at different distances from the top opening of the bag. In some cases, the first member may be disposed above the second member. In other cases, the second member may be disposed above the first member. In some cases, the first member may be positioned further away from the base of the top cuff than the second member. In other cases, the second member may be positioned further away from the base of the top cuff than the first member.

In some cases, the first and second members may be configured to converge at or near the front or rear portions of the top cuff (e.g., at the exposed front panel at the front of the top cuff, or at the integrated handle at the rear of the top cuff). In some cases, the first and second members may be configured to diverge along the side portion(s) of the top cuff. In some cases, the first and second members may diverge to form one or more aperture, windows, or openings 107 along the side portion(s) of the top cuff. In some embodiments, the top cuff 102 may comprise one or more apertures, windows, or openings 107. In some cases, the one or more apertures, windows, or openings 107 may be disposed between a first member 111-1 and a second member 111-2 of the top cuff 102.

In some cases, a lining of the golf bag may be configured to extend through the one or more apertures, windows, or openings 107. In other cases, a portion or section of the one or more body panels may be configured to extend through the one or more apertures, windows, or openings 107. In some cases, the lining and/or the one or more body panels may be configured to wrap over or around the first member 111-1 and/or the second member 111-2.

In some cases, the one or more body panels may be configured to extend across the one or more apertures, windows, or openings 107 without passing through the apertures, windows, or openings 107. In some cases, the one or more body panels may be configured to extend across the one or more apertures, windows, or openings 107 without passing between the first member and the second member. In some cases, the one or more body panels may be configured to extend above and/or below the one or more apertures, windows, or openings 107 (e.g., to wrap around or over the first and/or second members).

Figure 4B:
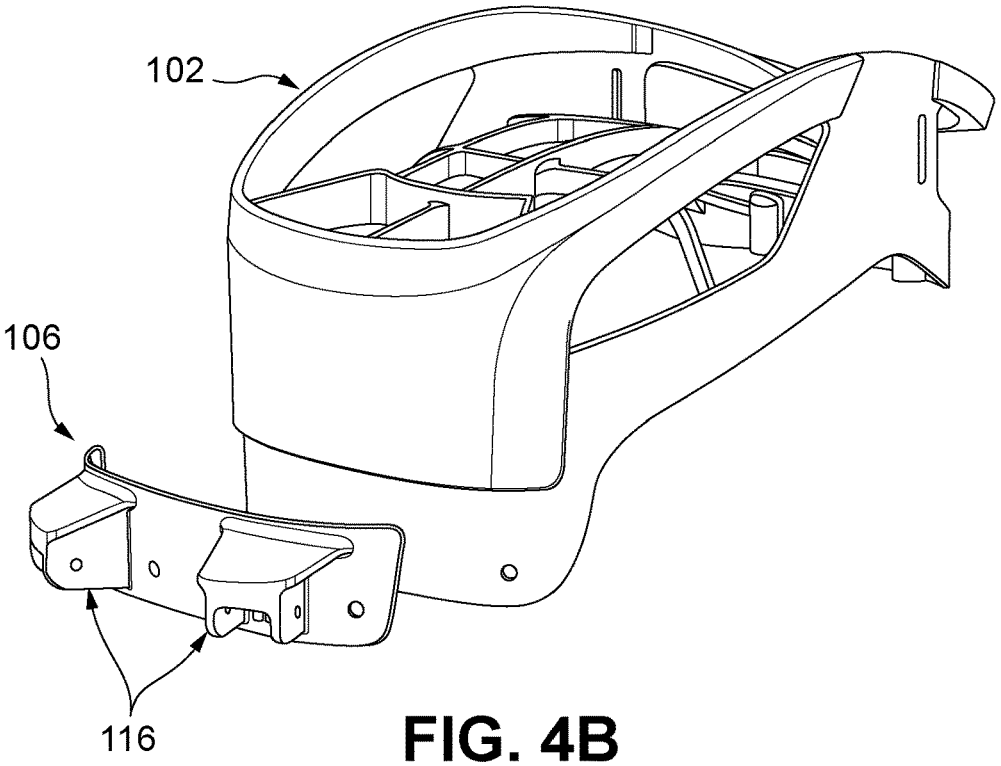

FIG. 4B illustrates another exemplary top cuff 102 according to embodiments of the present disclosure. In some cases, a select outer portion of the top cuff 102 may be recessed (e.g., by removing material from the select outer portion of the top cuff) to accommodate one or more body panel sections or segments extending along or over the outer surfaces of the top cuff 102 before wrapping around or over the top cuff 102. In some cases, the top cuff 102 may comprise additional material provided along a select inner portion of the top cuff to stiffen the top cuff. In some cases, the select inner portion may be opposite the select outer portion. The enhanced structural support provided by the additional material in the select inner portion may compensate for or offset any change in structural support due to the removal of material in the select outer portion to accommodate the body panel sections or segments.

In some cases, the top cuff may comprise a plurality of dividers configured to define one or more compartments for receiving the one or more golf clubs and/or various golf-related equipment. The plurality of dividers may be configured to extend across the top opening of the golf bag body. In some cases, the plurality of dividers may comprise a rigid material. In other cases, the plurality of dividers may comprise an extensible or elastic material.

Lining

Referring to FIGS. 5, 6A-6B, 9, 10, and 12A-12E, in some embodiments, the golf bag may comprise a lining 201. In some embodiments, the lining 201 may comprise a foam material. In some cases, the lining 201 may be configured to extend around or over the top cuff. In some cases, the portion of the lining 201 extending around or over the top cuff may be secured to an inner surface of the top cuff.

In some embodiments, the lining 201 may be configured to cover or wrap at least a portion of the top cuff 102. In some cases, the lining 201 may be configured to cover or wrap one or more select portions of the top cuff 102. In some cases, the one or more select portions may include the sides of the top cuff 102 under the apertures, windows, or openings disposed between the members of the top cuff 102. In some cases, the one or more select portions may include a rear lower portion of the top cuff 102. In some cases, the rear lower portion of the top cuff 102 may comprise a member extending under the integrated handle.

In some embodiments, the lining 201 may comprise a plurality of independently adjustable lining flaps. The independently adjustable lining flaps may be separated by a gap or a slit and separately attachable to different portions of the inner surface of the top cuff 102. In some cases, the independently adjustable lining flaps may be configured to wrap around the top cuff 102 and at least one of the plurality of dividers. In some cases, the independently adjustable lining flaps may include two or more lining flaps that can wrap around the sides or edges of the dividers.

Body Panels

As shown in FIGS. 1, 2, 5, and 6A-6B, in some cases, the body of the golf bag may comprise one or more body panels 101. In some embodiments, the one or more body panels 101 may comprise a fabric or a textile material. In some cases, the fabric or a textile material may be waterproof or water-resistant.

In some cases, the one or more body panels 101 may extend between the opening and the closed bottom of the bag. In some cases, the one or more body panels 101 may comprise at least one panel that extends continuously from the closed bottom to the top cuff of the golf bag.

In some cases, the body panels 101 may extend around a central region to form an enclosed or partially enclosed interior region for housing one or more golf clubs and/or other golf-related equipment. In some cases, the body panels 101 may extend around the one or more golf clubs to form the body of the golf bag. In some cases, the body panels 101 may extend around a frame structure or a support structure of the golf bag to form the body of the golf bag.

In some embodiments, the one or more body panels 101 may be configured to extend around or over the top cuff 102. In some cases, the one or more body panels may be configured to extend around and over a first portion of the top cuff. In some cases, the lining may be configured to extend around and over a second portion of the top cuff. In some cases, the first portion of the top cuff may be positioned above the second portion of the top cuff. In some cases, the first portion of the top cuff may be disposed further from the base of the top cuff than the second portion of the top cuff. In some cases, the first portion of the top cuff may correspond to an uppermost edge of the top cuff. In some cases, the second portion of the top cuff may correspond to a part of the top cuff that is positioned below the uppermost edge of the top cuff.

In some cases, the one or more body panels and the lining may be secured or positioned along different portions of the inner surface of the top cuff. In some cases, the one or more body panels may be secured or positioned along a first portion of the inner surface of the top cuff. In some cases, the lining may be secured or positioned along a second portion of the inner surface of the top cuff. In some cases, the first and second portions of the inner surface of the top cuff may correspond to different areas or regions of the inner surface of the top cuff.

In some embodiments, the portion(s) of the body panels 101 extending around or over the top cuff 102 may be directly coupled to the portion(s) of the lining secured to the inner surface of the top cuff 102. In some embodiments, the portion(s) of the body panels 101 extending around or over the top cuff 102 may be directly and/or indirectly coupled to the inner surface of the top cuff 102.

In some embodiments, the portion(s) of the body panels 101 extending around or over the top cuff 102 may be directly and/or indirectly coupled to the inner surface of the top cuff 102. In some cases, a portion of the body panels may be attached directly to the inner surface of the top cuff. In some cases, a portion of the body panels may be attached indirectly to the inner surface of the top cuff. In some cases, a portion of the lining may be configured to indirectly couple the one or more body panels to the inner surface of the top cuff. In some cases, a first portion of the one or more body panels may be configured to indirectly couple a second portion of the one or more body panels to the inner surface of the top cuff.

In some cases, the portion of the body panels 101 extending around or over the top cuff 102 can be releasably coupled to the portion(s) of the lining secured to the inner surface of the top cuff 102. In some cases, one or more hook and loop fasteners may be used to detachably couple the body panels 101 to the portion(s) of the lining secured to the inner surface of the top cuff 102.

In some embodiments, the one or more body panels 101 may be configured to overlap the portion(s) of the lining that are secured to the inner surface of the top cuff 102. In some embodiments, the body panels 101 may overlap the lining such that the lining is positioned between the body panels 101 and the inner surface of the top cuff 102.

In some cases, the one or more body panels may not or need not overlap the portion(s) of the lining that are wrapped over the top cuff. In some cases, the one or more body panels and the lining may extend around and over different portions of the top cuff. In some cases, the one or more body panels and the lining may overlap or extend along different portions of the inner surface of the top cuff.

In some embodiments, a first portion of the one or more body panels 101 may be positioned around the front portion of the golf bag, between the top cuff 102 and a knuckle bracket 106 of the golf bag. In some embodiments, a second portion of the one or more body panels 101 may extend along a side of the golf bag and wrap around the top cuff 102. In some cases, the first portion and the second portion may comprise separate and distinct panels that partially overlap or cover each other. In other cases, the first and second portions may be part of a same body panel formed of a single continuous piece of material.

In some non-limiting embodiments, the one or more body panels 101 may comprise (i) a first body panel and a second body panel extending around opposite sides of the top cuff 102 and (ii) a rear body panel. The rear body panel may extend along a back side or a rear portion of the golf bag body (e.g., the portion of the golf bag body that extends under the integrated handle formed with the top cuff). In some cases, the rear portion of the golf bag may be opposite the front portion of the golf bag where the legs of the bag are pivotably attached. In some cases, a distance between an edge of the first body panel and an edge of the second body panel may be equal to or approximately equal to a width of a bottom portion of the rear body panel of the golf bag.

In some embodiments, the one or more body panels may comprise a first portion and a second portion. In some cases, the first portion may be attached to the second portion. In some cases, the second portion may be attached to the first portion. In some cases, the first portion may be configured to extend from the second portion. In some cases, the second portion may be configured to extend from the first portion.

In some cases, the first portion and the second portion may comprise separate flaps extending from the same body panel. In some cases, the separate flaps may be extendable around or over a same portion of the top cuff. In some cases, the separate flaps may be extendable around or over different portions of the top cuff. In some cases, the separate flaps may be configured to overlap a same portion of the inner surface of the top cuff. In some cases, the separate flaps may be configured to overlap different portions of the inner surface of the top cuff. In some cases, the separate flaps may be configured to overlap each other. In other cases, the separate flaps may not or need not overlap each other.

In some cases, the first portion may be configured to extend through an aperture or a window formed between an upper member of the top cuff and a lower member of the top cuff. In some cases, the first portion may be configured to extend laterally along the inner surface of the top cuff towards a rear portion of the top cuff. In some cases, the first portion may be attachable directly to the inner surface of the top cuff. In other cases, the first portion may be attachable to the second portion, which may indirectly couple the first portion to the inner surface of the top cuff.

In some cases, the first portion may have one or more extensions configured to extend downwards along the inner surface of the top cuff towards the bottom edge of the top cuff. In some cases, the one or more extensions may be configured to extend around one or more dividers extending across the opening of the golf bag.

In some cases, the second portion may be configured to extend around and over an uppermost edge of the top cuff. In some cases, the second portion may be configured to extend downwards along the inner surface of the top cuff from the uppermost edge of the top cuff towards the bottom edge of the top cuff. In some cases, the second portion may be attachable to the first portion, which may indirectly couple the second portion to the inner surface of the top cuff. In other cases, the second portion may be attachable directly to the inner surface of the top cuff.

In some cases, the second portion may have one or more extensions configured to extend downwards along the inner surface of the top cuff towards the bottom edge of the top cuff. In some cases, the one or more extensions may be configured to extend around one or more dividers extending across the opening of the golf bag. In some cases, the extensions of the second portion may extend around a same divider as the extensions of the first portion.

Knuckle Bracket

As shown in FIGS. 3A-3B, 4A-4B, 5, and 6A-6B, in some embodiments, the golf bag may comprise a knuckle bracket 106 with knuckles 116 configured to interface with one or more legs for supporting the golf bag. In some cases, the knuckle bracket 106 and the top cuff 102 may comprise separately provided components that are not integrally formed. In some cases, the knuckle bracket 106 and the top cuff 102 may be fastened using one or more fasteners. In other cases, the knuckle bracket 106 and the top cuff 102 may not or need not comprise separate components that are individually formed and subsequently fastened together. In some cases, the knuckle bracket 106 and the top cuff 102 may be integrally formed as a single unitary assembly. In some cases, the single unitary assembly may be formed using a manufacturing step or process that does not involve fastening or joining two separately formed components together. In some cases, the manufacturing step or process may include a molding process in which the top cuff is formed with the knuckle bracket already integrated with the rest of the top cuff. In some cases, the manufacturing step or process may include a molding process in which the top cuff is formed with the knuckle bracket already included as part of the top cuff.

Figure 5:
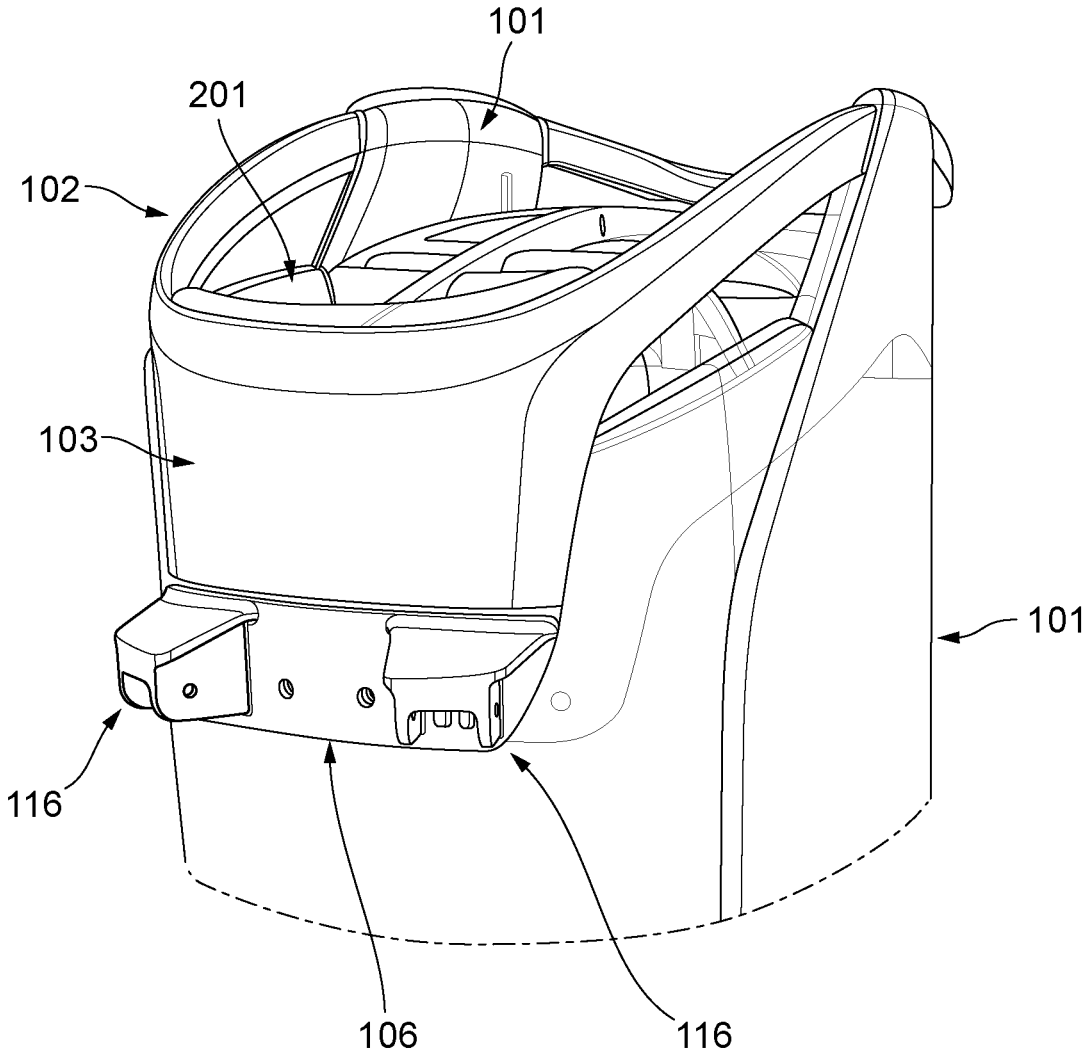
FIGS. 5 and 6A-6B illustrate an example of a golf bag with a wrapped top cuff, in accordance with some embodiments.
Figure 6A:
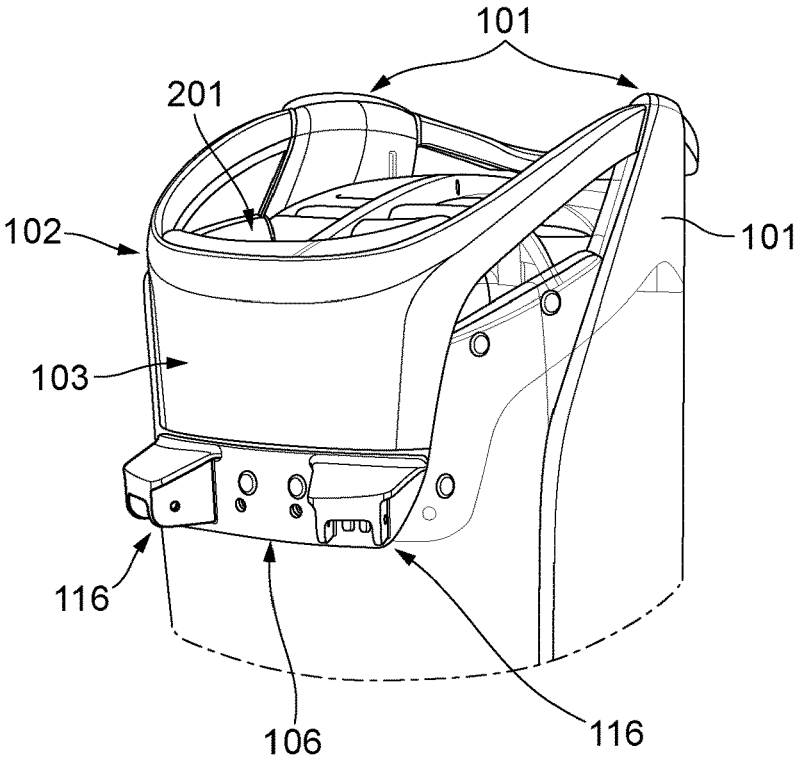
Figure 6B:
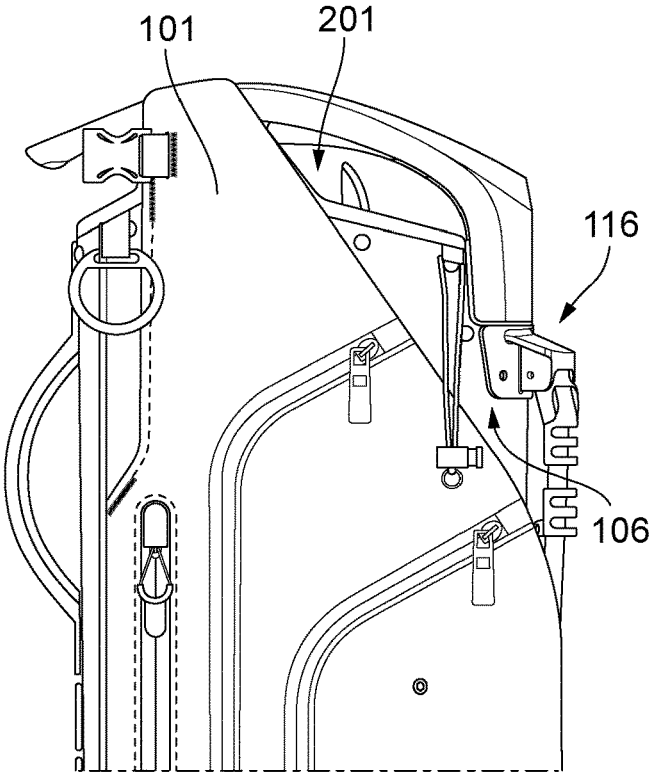

FIGS. 5 and 6A-6B illustrate an exemplary golf bag comprising a top cuff 102 and one or more body panels 101 configured to extend or wrap around a portion of the top cuff 102. FIGS. 5 and 6A illustrate a perspective view of a first side of the golf bag. FIG. 6B illustrates a side view of a second side of the golf bag. The second side of the golf bag (as shown in FIG. 6B) may be opposite the first side of the golf bag shown in FIGS. 5 and 6A. In some cases, both the first side and the second side of the golf bag may include one or more body panels 101 as described elsewhere herein. In some cases, at least a portion of the one or more body panels 101 may be configured to extend up to and wrap around or over the top cuff. The portion of the body panels 101 wrapping around or over the top cuff may be directly connected to the inner lining along an inner surface of the top cuff.

In some cases, at least one panel of the golf bag may extend around a front portion of the golf bag without covering or concealing the exposed front panel on the front portion 103 of the top cuff 102. In some cases, said at least one panel may extend around the front side of the golf bag without covering or concealing any portion of the knuckle bracket 106. The top cuff 102 may be wrapped as shown in the accompanying figures in order to expose the front panel of the top cuff 102 as well as the side and back handles of the top cuff 102.

In some embodiments, a portion of the one or more body panels 101 may be disposed between the knuckle bracket 106 and a lower (front) portion of the top cuff 102. In some embodiments described herein, the one or more body panels 101 may not or need not cover or overlap the knuckle bracket 106 or an upper portion (e.g., the exposed front panel) of the top cuff 102. In some cases, the one or more body panels 101 may extend along or under the upper (front) portion of the top cuff 102. In some cases, the knuckle bracket 106 may be positioned (i) along the lower (front) portion of the top cuff 102 and (ii) below or under the upper (front) portion of the top cuff 102.

Fasteners

In some embodiments, the golf bag may comprise one or more fasteners for securing the lining, a separate front liner piece, and/or the one or more body panels to the top cuff. In some cases, the one or more fasteners may be attached to or integrated with a portion of the top cuff. In some cases, the one or more fasteners may be attached to or integrated with the lining, the separate front liner piece, and/or the one or more body panels.

In some embodiments, the golf bag may comprise one or more tabs for securing the lining, the separate front liner piece, and/or the one or more body panels to the top cuff. In some cases, the one or more tabs may be attached to or integrated with the lining, the separate front liner piece, and/or the one or more body panels.

In some embodiments, a combination of fasteners (e.g., Velcro) and tabs (e.g., PE tabs) may be used to secure the lining, the separate front liner piece, and/or the one or more body panels to each other and/or to the top cuff. In some cases, the fasteners and/or the tabs may be attached to or integrated with (i) the lining, (ii) the separate front liner piece, (iii) the one or more body panels, and/or (iv) a portion of the top cuff (e.g., an inner surface of the top cuff).

Channel Slot

In some embodiments, the top cuff may comprise a channel slot extending along the inner surface of the top cuff. In some cases, the channel slot may extend along an inner surface of the front portion of the top cuff. In some cases, the channel slot may be configured to provide a structural support that the lining or a separate front liner piece can wrap around or over.

In some non-limiting embodiments, the lining may comprise one or more integrated tabs that are insertable into the channel slot to secure the lining to the inner surface of the top cuff. In other non-limiting embodiments, the separate front liner piece may comprise one or more integrated tabs that are insertable into the channel slot to secure the front liner piece to the inner surface of the top cuff. In some alternative embodiments, the one or more body panels may comprise one or more integrated tabs that are insertable into the channel slot to secure the one or more body panels to the inner surface of the top cuff.

As described elsewhere herein, the top cuff of the golf bag may comprise a plurality of dividers extending across the top frame to define a plurality of compartments. In some cases, the plurality of dividers may comprise one or more dividers terminating directly at the inner surface of the top cuff. In some cases, the plurality of dividers may comprise at least one divider terminating at the channel slot disposed along an inner surface of the top cuff. In some cases, the at least one divider terminating at the channel slot may not or need not directly contact the inner surface of the top cuff.

Figure 7:
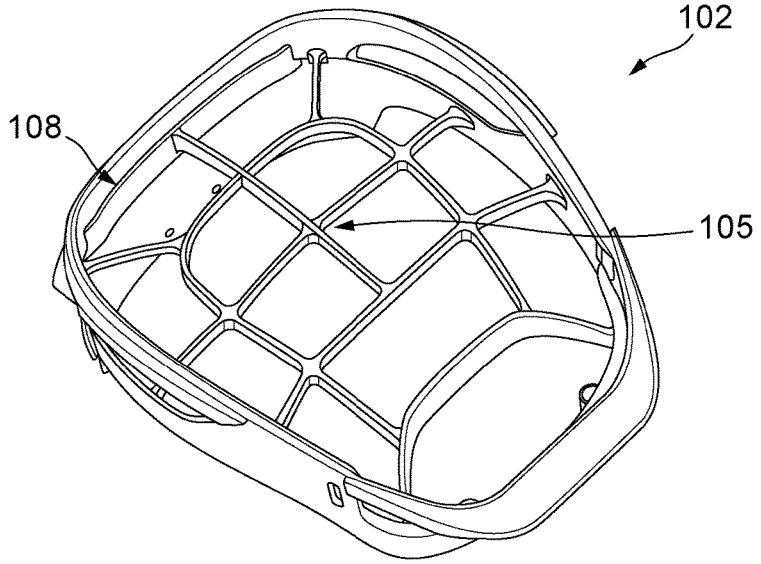
FIGS. 7 and 8 illustrate a channel slot that can be provided along an inner surface of the top cuff, in accordance with some embodiments.
Figure 8:
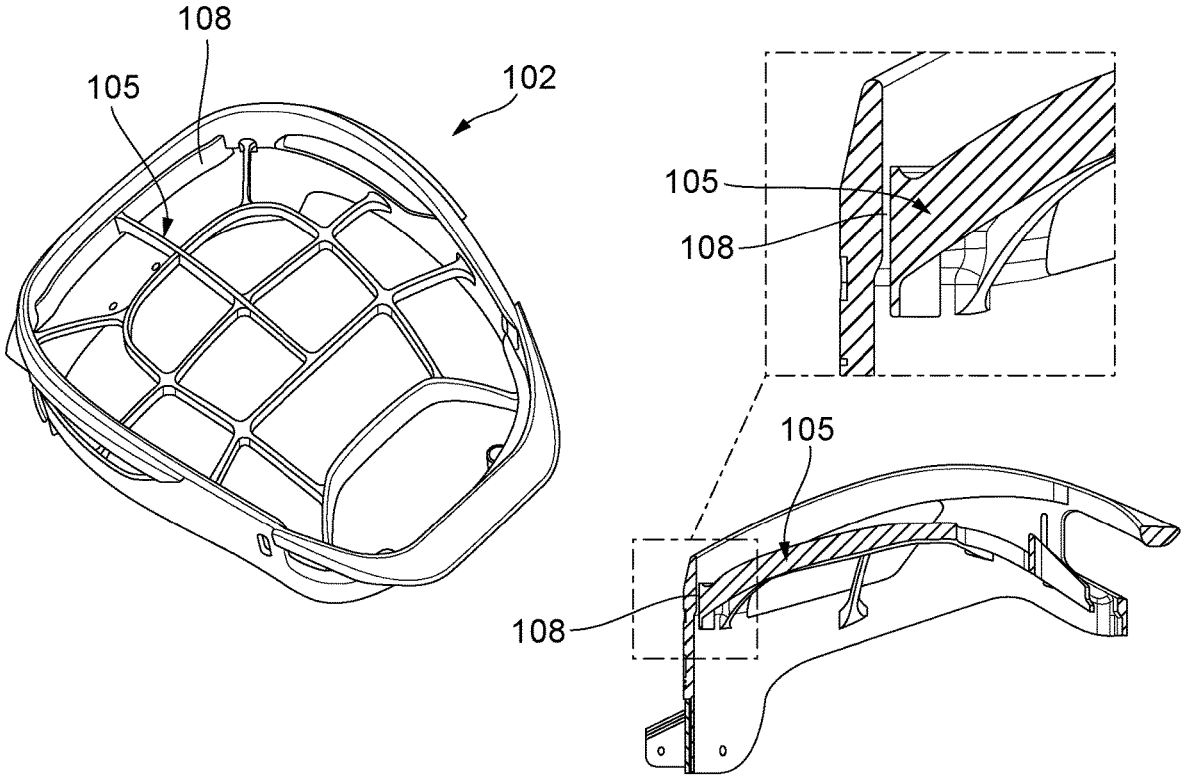

FIGS. 7 and 8 illustrate an example of a top cuff 102 comprising a channel slot 108 for receiving and securing a front liner piece or panel to the top cuff 102. The channel slot 108 may be configured to extend along an inner surface of the top cuff 102. In some cases, the channel slot 108 may have a width ranging from about 1 millimeter (mm) to about 2 millimeters. In some cases, the width of the channel slot 108 may be less than 1 mm. In other cases, the width of the channel slot 108 may be greater than 2 mm. In some cases, the length of the channel slot 108 may correspond to a width of the front liner piece or panel that is inserted into the channel slot 108.

In some embodiments, the top cuff 102 may comprise a plurality of dividers 105 configured to define one or more compartments for housing one or more golf clubs. In some cases, a center divider of the plurality of dividers 105 may be configured to extend from a central region of the top opening to a wall of the channel slot 108. In some cases, the center divider may not or need not directly contact an inner surface or wall of the top cuff 102. In some cases, one or more other dividers of the top cuff 102 may be configured to extend from the central region of the top opening to the inner surface or wall of the top cuff 102. In some cases, the one or more other dividers may be configured to directly contact the inner surface or wall of the top cuff 102.

Figure 9:
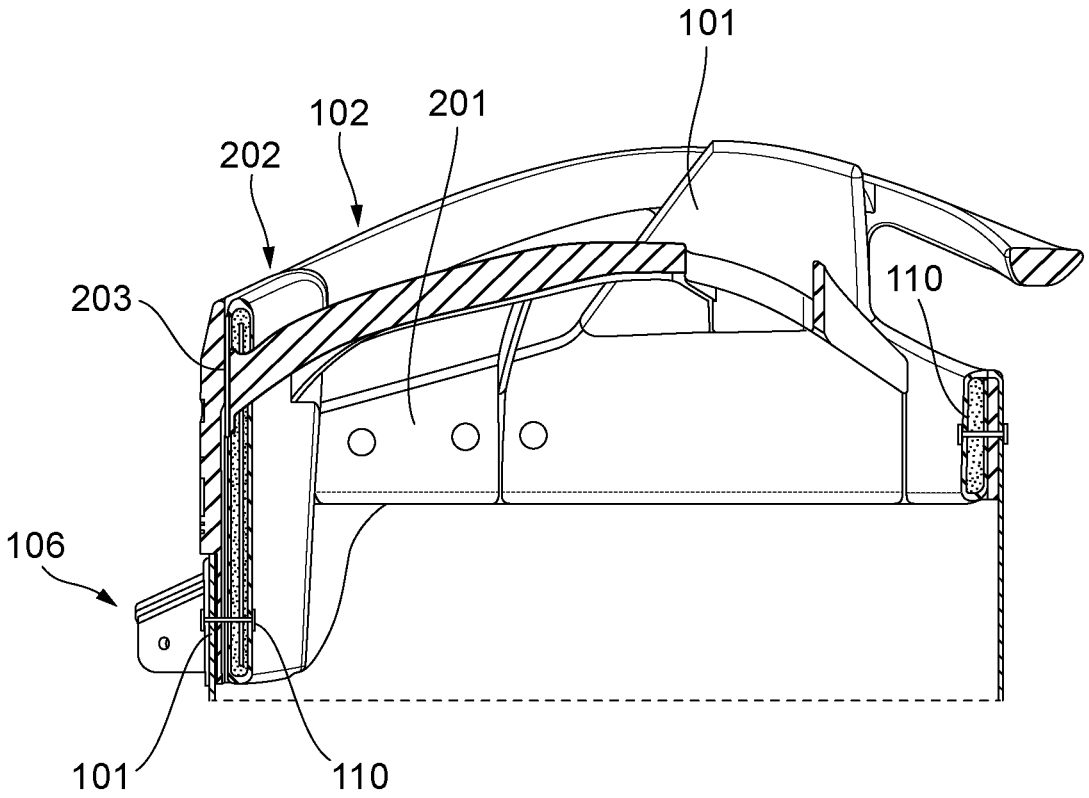
FIGS. 9 and 10 illustrate a cross-sectional view of a golf bag comprising a top cuff wrapped with a lining and one or more body panels, in accordance with some embodiments.
Figure 10:
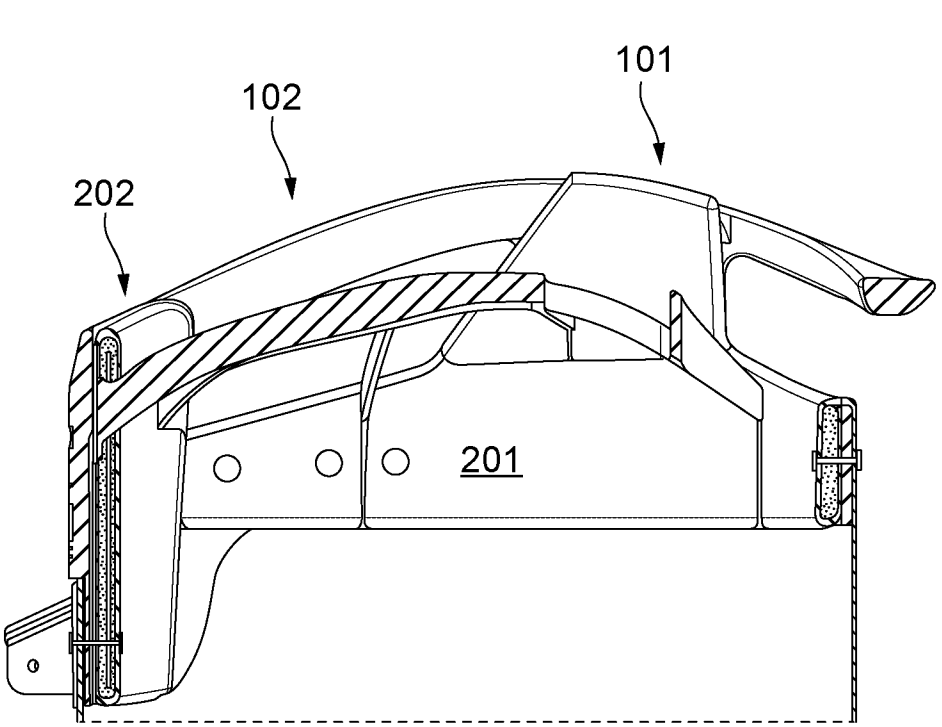
Figure 10:
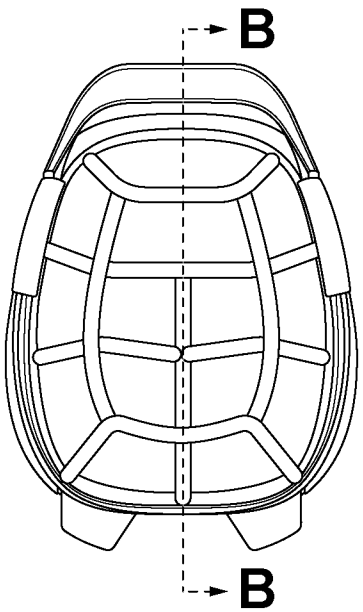

FIGS. 9 and 10 illustrate a cutaway side view of a top cuff 102 with one or more body panels 101 wrapped around or over the top cuff 102. In some cases, the golf bags of the present disclosure may include a lining 201 that wraps around or over the top cuff. The lining may include, for example, a foam material. In some cases, the lining 201 may be fixed in place using one or more fasteners 110 (e.g., one or more rivets). In some embodiments, one or more body panels 101 may wrap around or over the top cuff 102 and attach directly to the lining 201 (e.g., using a fastener or other attachment mechanism). In some cases, the lining 201 and the one or more body panels 101 may wrap around or over a same portion of the top cuff 102. In other cases, the lining 201 and the one or more body panels 101 may wrap around or over different portions or sections of the top cuff 102.

Separate Front Liner Piece

In some embodiments, the golf bag may comprise a front liner piece that is separate from the lining. In some cases, the front liner piece may comprise a different material than the lining. In some cases, the front liner piece may have a different construction than the lining. In some cases, the front liner piece may comprise a support board and/or a foam material.

In some embodiments, the front liner piece may be independently securable around an inner front portion of the top cuff. In some cases, the inner front portion of the top cuff may correspond to the channel slot extending along the inner surface of the top cuff. In some cases, the front liner piece may comprise one or more integrated tabs that are insertable into the channel slot to secure the front liner piece to the inner surface of the top cuff.

In some embodiments, at least one fastener may be used to secure a portion of the front liner piece (e.g., a bottom portion of the front liner piece) to a front portion of the top cuff. In some cases, the same fastener may also secure the knuckle bracket and a front-facing portion of the one or more body panels to the front portion of the top cuff. In some non-limiting embodiments, the at least one fastener may include, for example, one or more rivets.

In some embodiments, the front liner piece may be configured to extend around and over a first portion of the top cuff, and the lining may be configured to extend around and over a second portion of the top cuff. In some cases, the first portion and the second portion may correspond to different areas or regions of the top cuff. In some cases, the first portion may include a front portion of the top cuff or a portion of the top cuff that is adjacent or proximal to the front portion of the top cuff. In some cases, the second portion may include the side portions of the top cuff or a portion of the top cuff that is adjacent or proximal to the side portions of the top cuff.

In some cases, the first portion of the top cuff may be vertically offset from the second portion of the top cuff. In some cases, the first portion of the top cuff may be positioned above the second portion of the top cuff. In some cases, the first portion of the top cuff may be further away from the base or lower edge of the top cuff than the second portion of the top cuff. In some cases, the first portion of the top cuff may be closer towards the uppermost edge of the top cuff than the second portion of the top cuff.

In some cases, the first portion of the top cuff may be laterally offset from an upper front side edge of the top cuff. In some cases, the first portion of the top cuff may be laterally offset from an upper edge of the exposed front panel of the top cuff. In some cases, the first portion of the top cuff may be offset or spaced apart from the back side of the exposed front panel.

As shown in FIGS. 9 and 10, in some embodiments, a separate front liner piece 202 can be wrapped around or over an inner front portion of the top cuff 102. In some cases, the inner front portion may correspond to a side or a wall of a channel slot extending along the inner surface of the top cuff. In some cases, the inner front portion may correspond to an inner wall of the top cuff that is spaced apart and inwardly from the inner surface of the top cuff to form a channel slot extending along the inner front portion of the top cuff.

In some cases, the front liner piece may be wrapped around the inner wall to provide a protective layer or cover at or near the top front portion of the top cuff. In some cases, the protective layer or cover may be offset from the upper front side edge of the top cuff. In some cases, the front liner piece may be configured to extend behind the exposed front panel. In some cases, the front liner piece may be configured to extend along the back side of the exposed front panel. In some cases, the front liner piece may not or need not extend across or overlap a front side or an outer surface of the exposed front panel. In some cases, the front liner piece may not or need not extend over or wrap around the upper edge of the exposed front panel.

In some cases, the front liner piece 202 may comprise a front lining panel. In some cases, the front lining panel may comprise a polyethylene backer board and a foam material attached to the backer board.

In some cases, the front liner piece 202 may comprise one or more integrated tabs 203. In some cases, the one or more integrated tabs may be attached to a frontside or a backside of the front liner piece 202. The one or more integrated tabs 203 may be inserted into a channel slot provided on an inner surface of the top cuff 102. The integrated tabs 203 may be configured to secure the front liner piece 202 to the top cuff 102.

In some cases, a bottom portion of the front liner piece 202 may be attached to the top cuff using one or more fasteners 110. In some cases, the one or more fasteners 110 may be configured to couple the bottom portion of the front liner piece 202 to the top cuff 102, the knuckle bracket 106, and a portion of the one or more body panels 101 extending around the front of the bag body. In some cases, the same fastener 110 may be used to secure the one or more body panels 101 between the top cuff 102 and the knuckle bracket 106.

Figure 11:
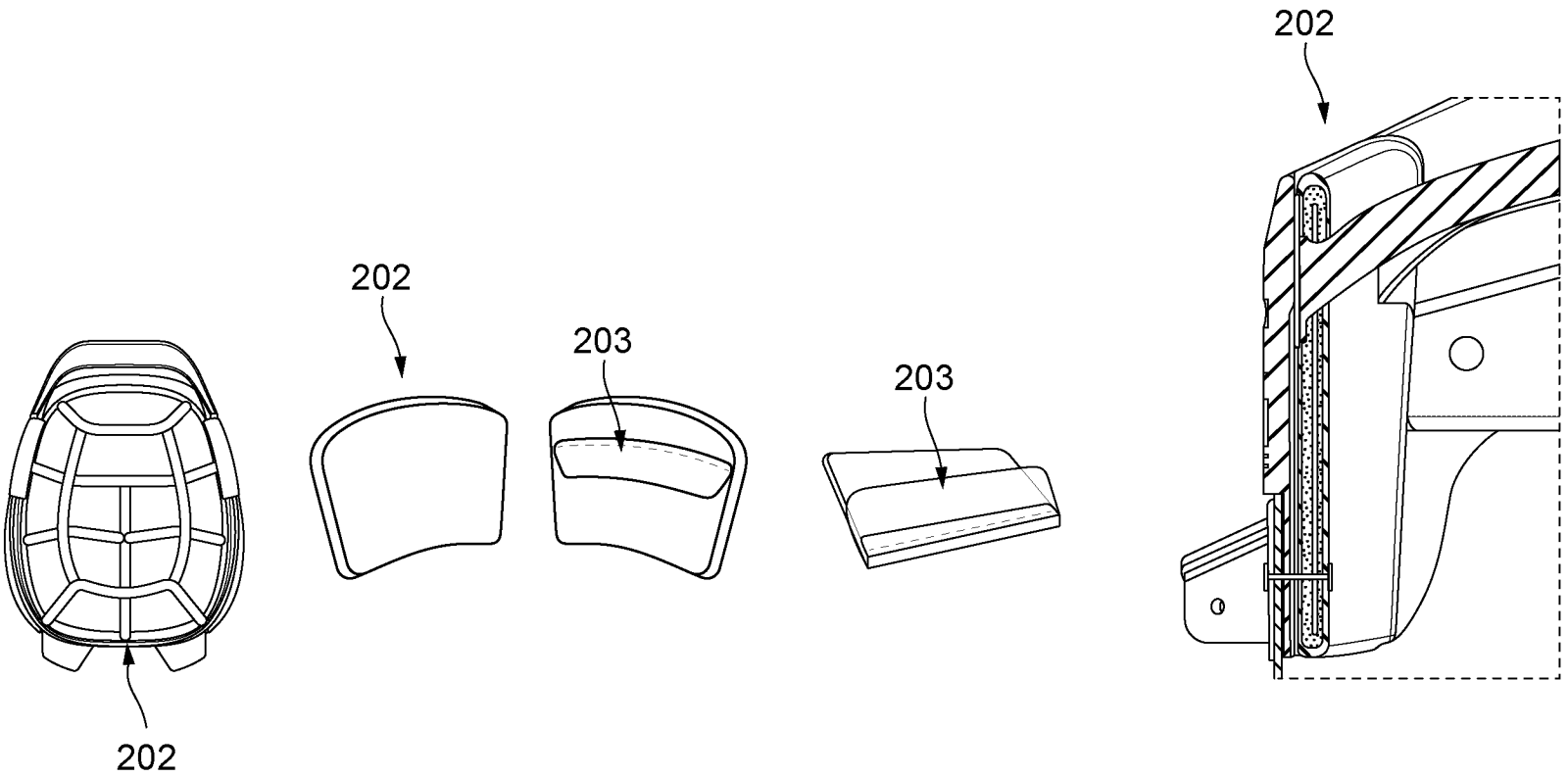
FIG. 11 illustrates an example of a front liner piece or panel that can be provided separately from the lining of the golf bag, in accordance with some embodiments.

FIG. 11 illustrates an example of a separate front liner piece 202 that can be inserted into the channel slot of the top cuff. The front liner piece 202 may be positioned along an interior surface of the front portion of the top cuff. In some cases, the front liner piece 202 may be configured to extend through the channel slot and wrap around or over a portion of the channel slot.

In some cases, the front liner piece 202 may include one or more tabs 203 that are configured to fit into the top cuff slot to secure the front liner piece 202 to the top cuff. In some cases, the one or more tabs 203 may be provided on a backside of the front liner piece 202. The backside of the front liner piece 202 may correspond to a side of the front liner piece 202 that is oriented towards the inner surface of the top cuff. When inserted into the top cuff slot, the one or more tabs 203 may be positioned between the body of the front liner piece 202 and the inner surface of the top cuff.

Figure 12A:
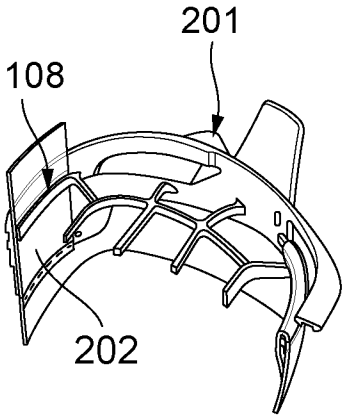
FIGS. 12A-12E illustrate a series of steps for wrapping a top cuff of a golf bag, in accordance with some embodiments.
Figure 12B:
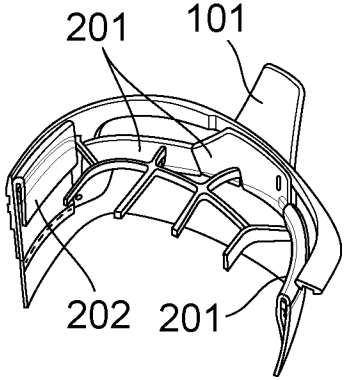
Figure 12C:
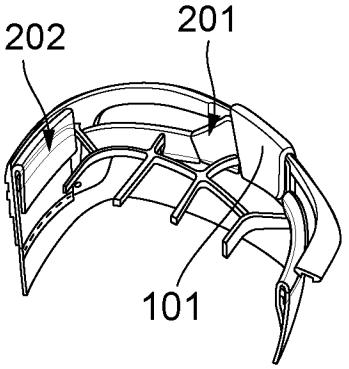
Figure 12D:
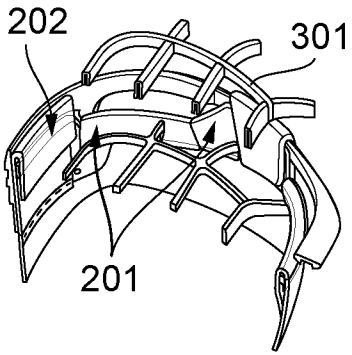
Figure 12E:
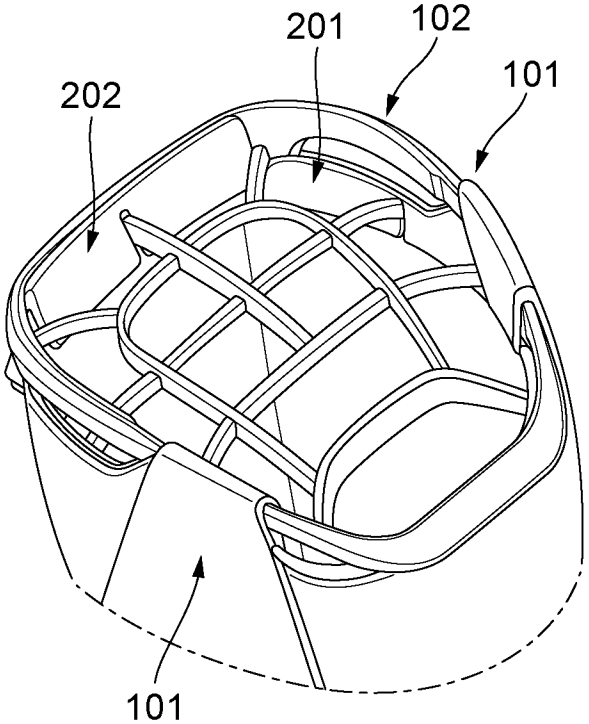

FIGS. 12A-2E schematically illustrate a series of steps for wrapping a top cuff of a golf bag. As shown in FIG. 12A, a front liner piece 202 can be inserted into a channel slot 108 provided on an interior surface of the front portion of the top cuff. As shown in FIG. 12B, the front liner piece 202 can be wrapped over a wall or edge of the channel slot. Additionally, the lining 201 of the golf bag can also be wrapped over various other portions of the top cuff. Further, a flap of the one or more body panels 101 may be wrapped over the top cuff and/or the lining 201. In some cases, the flaps of the body panels may be wrapped over the top cuff and directly secured to a portion of the lining 201 (e.g., as illustrated in FIG. 12C). Afterwards, a divider wrap 301 may be placed over the plurality of dividers (e.g., as shown in FIG. 12D). One non-limiting example of a golf bag with a wrapped top cuff 102 is shown in FIG. 12E. One or more portions or sections of the top cuff 102 may be wrapped or covered by the one or more body panels 101, the lining 201, and the separate front liner piece 202. As discussed above, the separate front liner piece 202 may be wrapped around an inner wall or edge of a channel slot that is provided along an inner surface of the top cuff 102. In some embodiments, the wrapped top cuff 102 may have one or more exposed sections on the front portion(s), the side portion(s), and/or the rear portion(s) of the top cuff. In some cases, the lining 201 and the body panels 101 may be wrapped over a same portion of the top cuff. In some cases, the separate front liner piece 202 may be wrapped over a different portion of the top cuff than the body panels 101 and/or the lining 201.

Velcro Attachment

In some cases, the front liner piece may be configured to wrap over onto itself, and a first portion of the front liner piece may be attachable to a second portion of the front liner piece. In some cases, the first and second portions of the front liner piece can be attached using a hook and loop fastener (e.g., Velcro).

Figure 13:
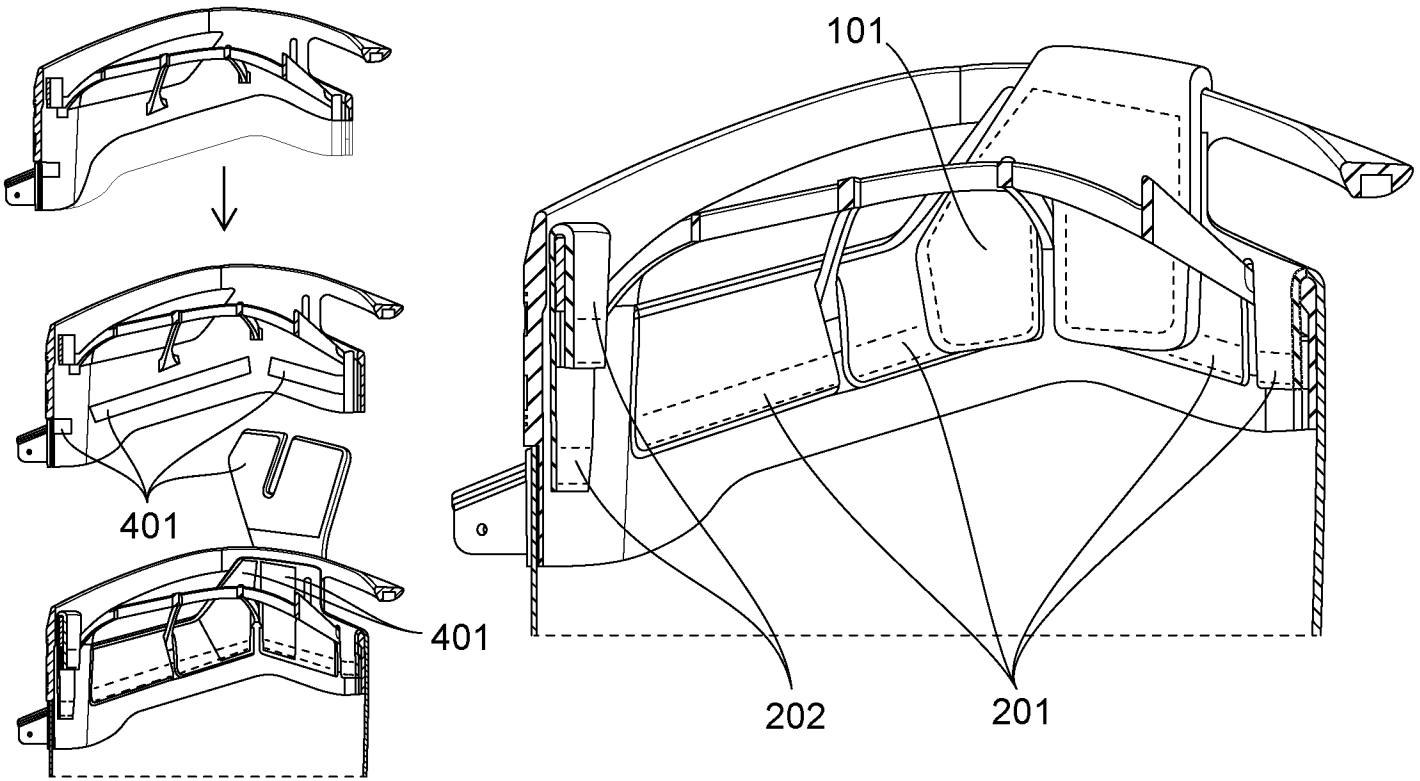
FIG. 13 illustrates a Velcro attachment method for affixing the body panels and/or the lining or front liner piece of the golf bag to the top cuff, in accordance with some embodiments.

FIG. 13 illustrates an example of a top cuff that can be wrapped with a panel or lining that is securable to the top cuff using one or more hook or loop fasteners 401 (e.g., Velcro). In some embodiments, a front portion of the top cuff can extend downwards to provide an inner surface along which the one or more hook or loop fasteners 401 can be provided or attached.

In some cases, a lining 201 of the golf bag may be configured to wrap around the back and/or side portions or edges of the top cuff. In some cases, the lining 201 may be attached to the inner surface of the top cuff using the one or more hook or loop fasteners 401. In some cases, the lining 201 may comprise one or more corresponding loop or hook fasteners that are configured to engage with the hook or loop fasteners 401 attached to the inner surface of the top cuff.

In some cases, a separate front liner piece 202 can extend through a channel slot provided along an inner surface of the top cuff. In some cases, the front liner piece 202 may comprise a panel that can wrap over or onto itself. In some cases, a first portion of the front liner piece 202 can be connected or attached to a second portion of the front liner piece 202 (e.g., using one or more hook and loop fasteners 401) after the front liner piece 202 is wrapped over or onto itself.

In some cases, one or more body panels 101 of the golf bag may be configured to wrap over the top cuff. In some cases, the one or more body panels 101 may comprise a loop or hook fastener that is configured to attach or couple the body panels 101 directly to the lining 201. In some cases, the lining 201 may comprise a material that can engage with the loop or hook fastener provided on the flaps of the body panels 101. In other cases, corresponding hook or loop fasteners can be provided on a surface of the lining 201 to which the body panels 101 are configured to directly attach or couple.

Tab and Slot Attachment

In some cases, the front liner piece, the lining, and/or the one or more body panels may comprise one or more integrated tabs. In some cases, the one or more integrated tabs may interface with a channel slot extending along an inner surface of the top cuff in order to secure the front liner piece, the lining, and/or the one or more body panels to a portion of the top cuff.

In some cases, the front liner piece, the lining, and/or the one or more body panels may be inserted into and wrapped around the channel slot extending along an inner surface of the top cuff. In some cases, one or more integrated tabs of the front liner piece, the lining, and/or the one or more body panels may be insertable into the channel slot from a bottom of the channel slot. In some cases, the integrated tabs may be configured to extend upwards into the channel slot from the bottom of the channel slot to secure the front liner piece, the lining, and/or the one or more body panels to the top cuff.

Figure 14A:
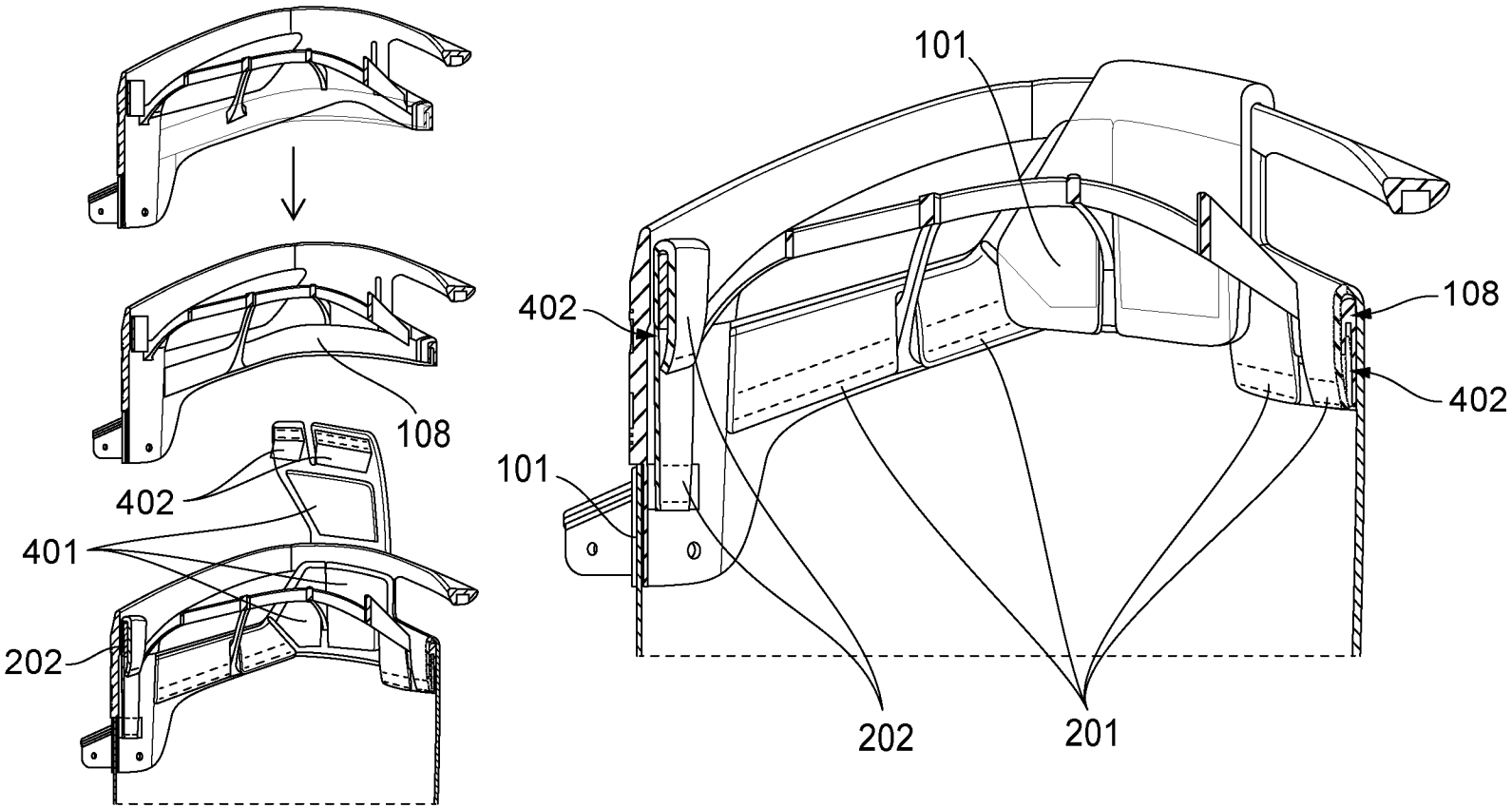
FIG. 14A illustrates a tab and slot attachment method for affixing the body panels and/or the lining or front liner piece of the golf bag to the top cuff, in accordance with some embodiments.

FIG. 14A illustrates an example of a top cuff that can be wrapped with a panel or lining that is secured using one or more slots and one or more tabs. In some embodiments, a portion of the inner surface of the top cuff can extend downwards to accommodate a channel slot 108 that extends along the inner surface of the top cuff.

In some cases, a lining 201 may be configured to wrap over or around the back and/or the side portions or edges of the top cuff. In some cases, the lining 201 may comprise one or more integrated tabs 402 that are insertable into the channel slot 108 from the bottom opening of the channel slot 108. The integrated tabs 402 may be configured to fix the lining 201 to the top cuff.

In some embodiments, a separate front liner piece 202 can be configured to extend through the channel slot 108 and wrap around or over a wall or an edge of the channel slot 108. In some cases, the front liner piece 202 may include one or more integrated tabs 402 that are insertable into the channel slot 108 from the bottom opening of the channel slot 108. The one or more integrated tabs 402 may be configured to fix the front liner piece 202 to the channel slot 108 formed along the inner surface of the top cuff.

In some embodiments, one or more bag body panels 101 can be configured to wrap over or around the top cuff. In some embodiments, the body panels 101 can be directly affixed to a portion of the lining 201 that is attached to the inner surface of the top cuff (e.g., using one or more hook and loop fasteners 401). In some embodiments, the body panels 101 may further comprise one or more integrated tabs that can be inserted into the bottom opening of the channel slot 108 to secure the body panels 101 to the channel slot 108 and/or the top cuff.

Figure 14B:
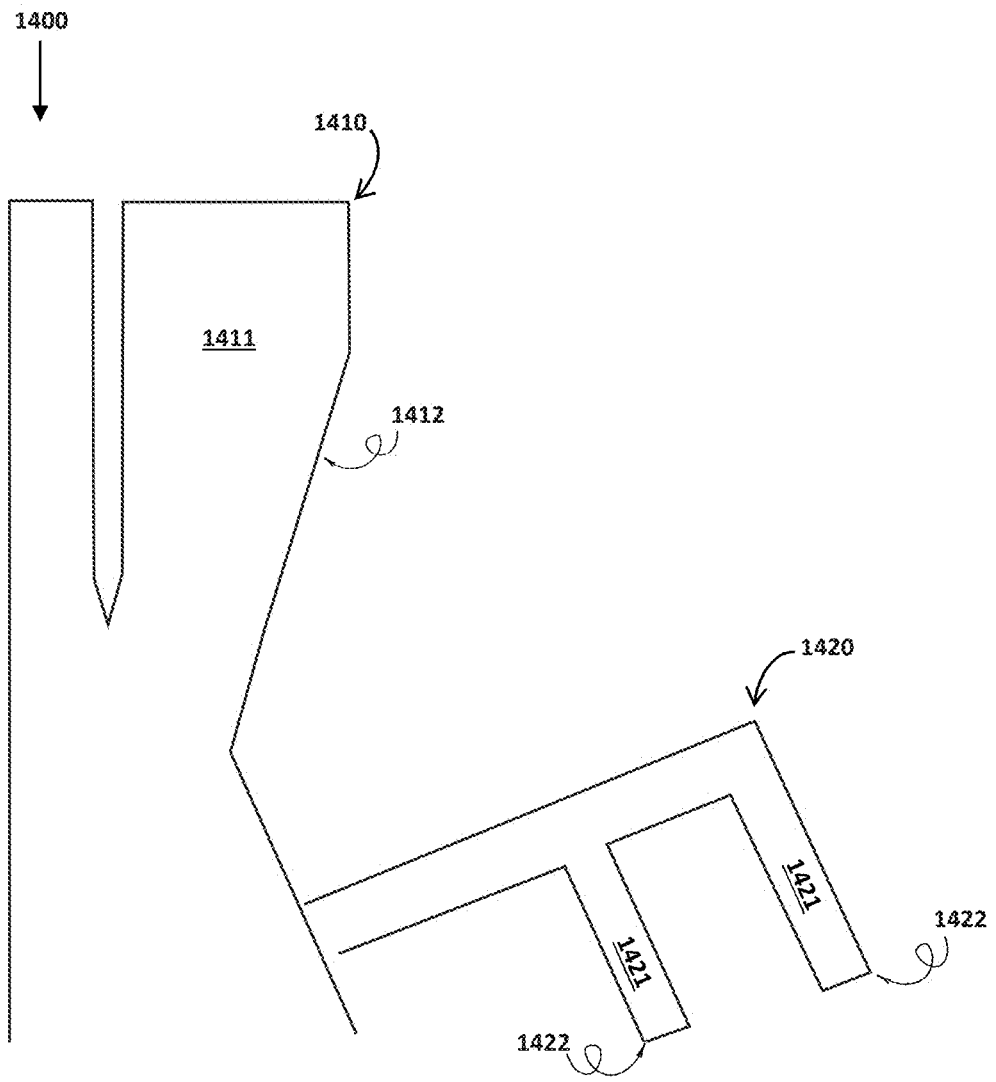
FIG. 14B illustrates a portion of the body panels that can be wrapped around and/or over the top cuff, in accordance with some embodiments.
Figure 15A:
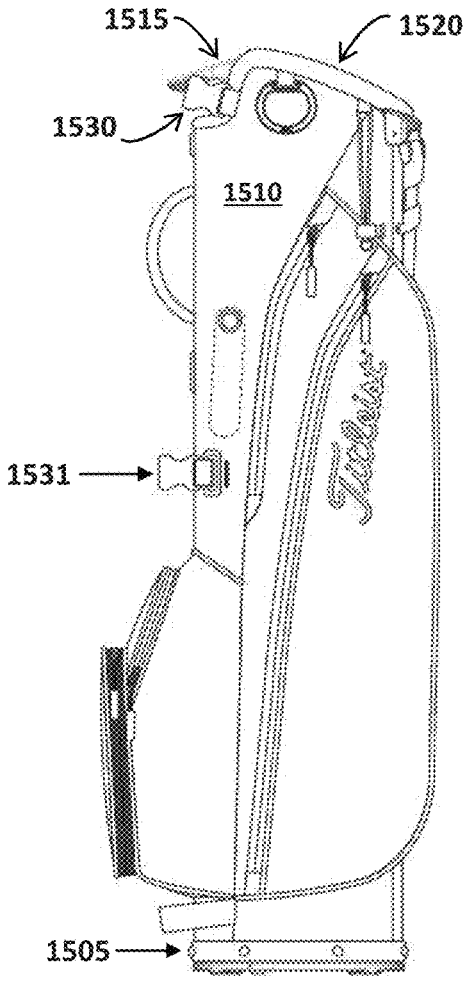
FIGS. 15A-15D schematically illustrate additional non-limiting examples of a golf bag with a top cuff, in accordance with some embodiments.
Figure 15B:
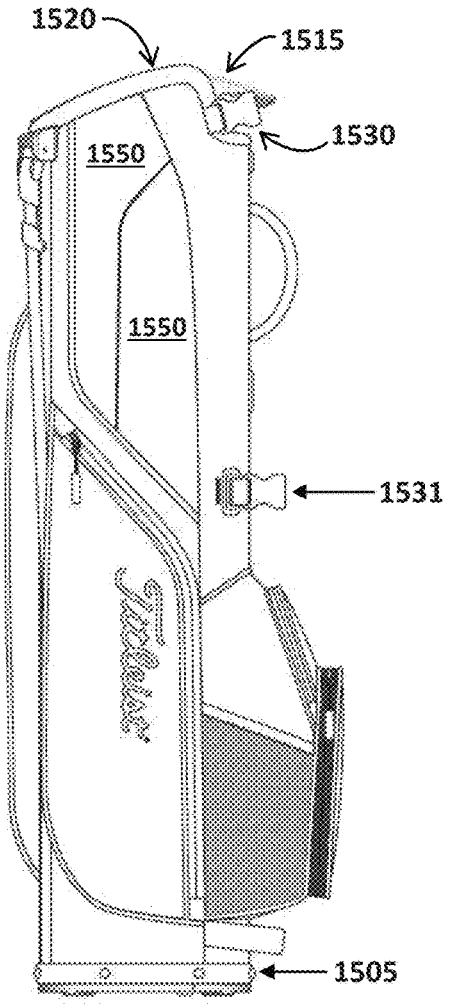
Figure 15C:
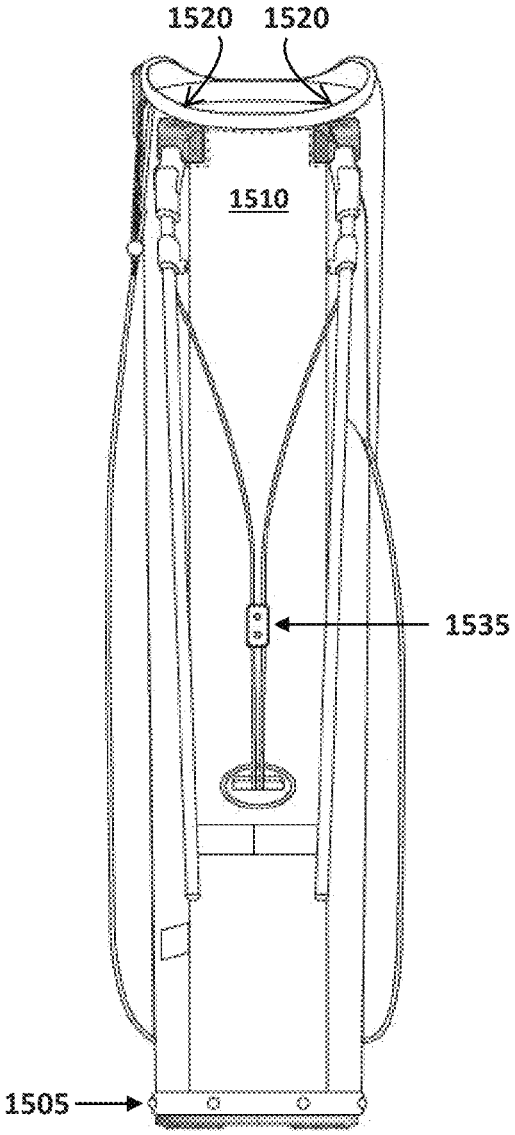
Figure 15D:
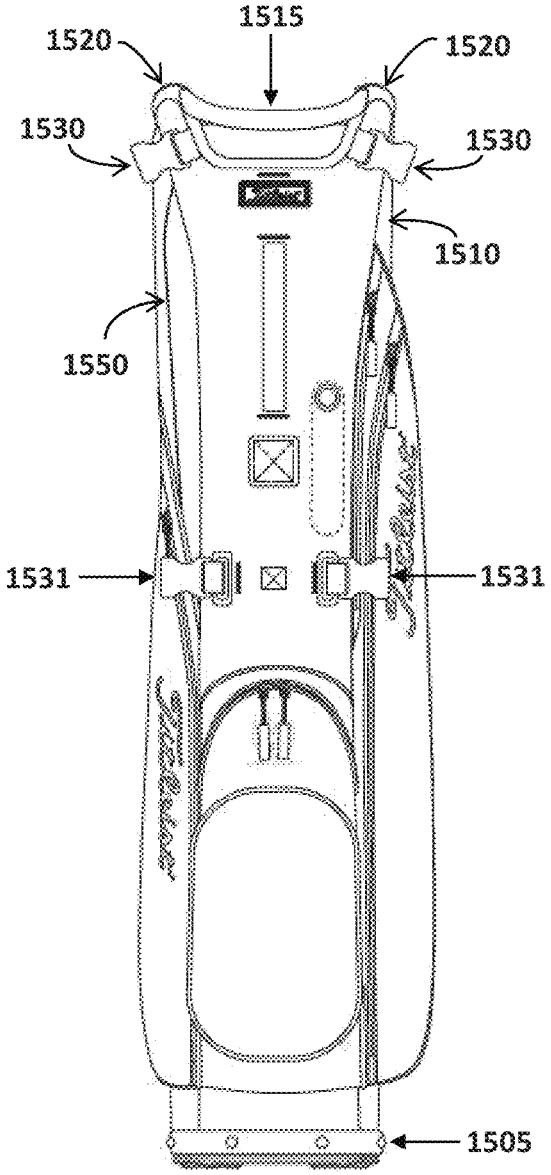

FIG. 14B illustrates an upper portion 1400 of the one or more body panels of the bag. In some cases, the upper portion 1400 may comprise a first portion 1410 and a second portion 1420. In some cases, the first portion may be attached to the second portion. In some cases, the second portion may be attached to the first portion. In some cases, the first portion may be configured to extend from the second portion. In some cases, the second portion may be configured to extend from the first portion.

In some cases, the first portion 1410 and the second portion 1420 may comprise separate flaps extending from the same body panel. In some cases, the separate flaps may be extendable around or over a same portion of the top cuff. In some cases, the separate flaps may be extendable around or over different portions of the top cuff. In some cases, the separate flaps may be configured to overlap a same portion of the inner surface of the top cuff. In some cases, the separate flaps may be configured to overlap different portions of the inner surface of the top cuff. In some cases, the separate flaps may be configured to overlap each other. In other cases, the separate flaps may not or need not overlap each other.

In some cases, the first portion 1410 may be configured to extend around and over an uppermost edge of the top cuff. In some cases, the first portion 1410 may be configured to extend downwards along the inner surface of the top cuff from the uppermost edge of the top cuff towards the bottom edge of the top cuff. In some cases, the first portion 1410 may be attachable to the second portion 1420, which may indirectly couple the first portion 1410 to the inner surface of the top cuff. In other cases, the first portion 1410 may be attachable directly to the inner surface of the top cuff.

In some cases, the first portion 1410 may have a first set of extensions configured to extend downwards along the inner surface of the top cuff towards the bottom edge of the top cuff. In some cases, the first set of extensions may be configured to extend around one or more dividers extending across the opening of the golf bag.

In some cases, the second portion 1420 may be configured to extend through an aperture or a window formed between an upper member of the top cuff and a lower member of the top cuff. In some cases, the second portion 1420 may be configured to extend laterally along the inner surface of the top cuff member towards a rear portion of the top cuff. In some cases, the second portion 1420 may be attachable directly to the inner surface of the top cuff. In other cases, the second portion 1420 may be attachable to the first portion 1410, which may indirectly couple the second portion 1420 to the inner surface of the top cuff.

In some cases, the second portion 1420 may have a second set of extensions configured to extend downwards along the inner surface of the top cuff towards the bottom edge of the top cuff. In some cases, the second set of extensions may be configured to extend around one or more dividers extending across the opening of the golf bag. In some cases, the second set of extensions may extend around a same divider as the first set of extensions.

In some cases, the first portion 1410 may have a first side 1411 with a fastener for securing the first side 1411 directly or indirectly to the inner surface of the top cuff. In some cases, the fastener may be configured to secure the first side 1411 of the first portion 1410 directly to the inner surface of the top cuff. In some cases, the fastener may be configured to secure the first side 1411 of the first portion 1410 to the second portion 1420, which may be positioned across the inner surface of the top cuff and between the first portion 1410 and the inner surface of the top cuff to facilitate an indirect coupling of the first portion 1410 to the inner surface of the top cuff.

In some cases, the first portion 1410 may have a second side 1412 opposite the first side. In some cases, the second side 1412 may optionally comprise another fastener configured to engage the second portion 1420. In some cases, the first portion 1410 may be wrapped around and over the top cuff first and secured directly to the inner surface of the top cuff. In some cases, the second portion 1420 may then be extended through the aperture or window in the top cuff and secured to the second side 1412 of the first portion 1410 to indirectly couple the second portion 1420 to the inner surface of the top cuff.

In some cases, the second portion 1420 may have a first side 1421 with a first fastener for securing the first side 1421 directly or indirectly to the inner surface of the top cuff. In some cases, the first fastener may be configured to secure the first side 1421 of the second portion 1420 directly to the inner surface of the top cuff. In some cases, the first fastener may be configured to secure the first side 1421 of the second portion 1420 to the first portion 1410, which may be positioned across the inner surface of the top cuff and between the second portion 1420 and the inner surface of the top cuff to facilitate an indirect coupling of the second portion 1420 to the inner surface of the top cuff.

In some cases, the second portion 1420 may have a second side 1422 opposite the first side. In some cases, the second side 1422 may optionally comprise another fastener configured to engage the first portion 1410. In some cases, the second portion 1420 may be extended through the aperture or window in the top cuff first and secured directly to the inner surface of the top cuff. In some cases, the first portion 1410 may then be wrapped around and over the top cuff and secured to the second side 1422 of the second portion 1420 to indirectly couple the first portion 1410 to the inner surface of the top cuff.

Additional Embodiments

In another aspect, the present disclosure provides various non-limiting examples of a lightweight golf bag that can be used to carry golf equipment. In some embodiments, the golf bag may comprise a bag body with a top opening, a closed bottom, and one or more body panels extending between the top opening and the closed bottom to form a partially enclosed interior region within the bag body for storing golf equipment.

FIGS. 15A-15D schematically illustrate various perspective views of a lightweight golf bag that can be used to carry golf equipment. In some cases, the golf bag may comprise a base 1505 forming the closed bottom of the golf bag. In some cases, the golf bag may comprise a top cuff 1515 arranged along the top of the golf bag to form the top opening of the golf bag.

Body Panel

In some cases, the golf bag may comprise one or more body panels. In some cases, the golf bag may comprise a body panel 1510 that is configured to extend between the base 1505 of the golf bag and a top cuff 1515 of the golf bag.

In some embodiments, the body panel 1510 may comprise a first surface and a second surface opposite the first surface. In some cases, the first surface may correspond to an interior or inner surface of the body panel (i.e., a surface of the body panel that is oriented inwards and/or towards the top cuff). In some cases, the second surface may correspond to an exterior or outer surface of the body panel (i.e., a surface of the body panel that is oriented outwards and/or away from the top cuff).

Fasteners

In some embodiments, the golf bag may comprise one or more fasteners configured to couple the one or more body panels to the top cuff. In some embodiments, the golf bag may comprise one or more fasteners configured to couple or secure the one or more body panels to a liner 1520 of the golf bag. In some embodiments, the golf bag may comprise one or more fasteners configured to couple the liner 1520 of the golf bag to the body panel 1510 and/or the top cuff 1515 of the golf bag.

In some cases, the one or more fasteners may comprise one or more rivets, screws, bolts, or pins. In some cases, the one or more fasteners may comprise one or more hook and loop fasteners (e.g., Velcro). In some cases, the one or more fasteners may comprise one or more stitches or seams. In some cases, the one or more fasteners may comprise one or more glues or adhesives.

In some cases, different fasteners may be used to couple different components of the golf bag together. For example, in some cases, a first type of fastener may be used to secure the body panels of the golf bag to the top cuff, and a second type of fastener may be used to secure the liner of the golf bag to the body panel(s) of the golf bag. In other cases, a same type of fastener may be used to couple (i) the body panels of the golf bag to the top cuff and (ii) the liner of the golf bag to the body panels.

Liner

In some embodiments, the golf bag may comprise a liner 1520 that is configured to extend around and/or over the top cuff 1515 of the golf bag. In some embodiments, the liner 1520 may comprise a lining that is extendable around and/or over the top cuff. In some cases, the lining may be configured to provide a soft and cushioned contact area for any golf equipment that is positioned within the bag or any equipment being moved into or out of the bag body.

In some embodiments, a portion of the lining may be folded over one or more fasteners used to couple the one or more body panels to the top cuff. In some embodiments, the folded portion of the lining may be configured to cover or conceal the one or more fasteners used to couple the one or more body panels to the top cuff.

In some embodiments, the lining may comprise (i) a first edge attached to the one or more body panels and (ii) a second edge that is securable (a) to an inner surface of the top cuff or (b) along an inner surface of the one or more body panels. In some embodiments, the first edge of the lining may be attached to the one or more body panels along a seam line that is at least partially (i) covered or concealed by another portion or section of the lining or (ii) tucked behind or under another portion or section of the lining.

In some embodiments, the lining may comprise a first liner piece and a second liner piece attached or coupled to the first liner piece along a seam line to form the lining. In some cases, the seam line joining the first liner piece and the second liner piece may be positionable along an upper edge of the top cuff when the second edge portion of the lining is wrapped around or over the top edge of the top cuff and secured (a) to an inner surface of the top cuff or (b) along an inner surface of the one or more body panels.

In some embodiments, the lining may comprise (i) a first liner section configured to extend around and over a first portion of the top cuff and (ii) a second liner section configured to extend around and over a second portion of the top cuff. In some embodiments, the first liner section may be configured to extend under a handle portion of the top cuff. In some embodiments, the second liner section may be configured to extend along, around, and over a side surface portion of the top cuff. In some cases, the side surface portion of the top cuff may be disposed between a handle assembly and a leg assembly of the golf bag. In some embodiments, the first liner section may be configured to overlap the second liner section or a portion thereof. In other embodiments, the second liner section may be configured to overlap the first liner section or a portion thereof. In some alternative embodiments, the first and second liner sections may not or need not overlap.

Top Cuff

Figure 16A:
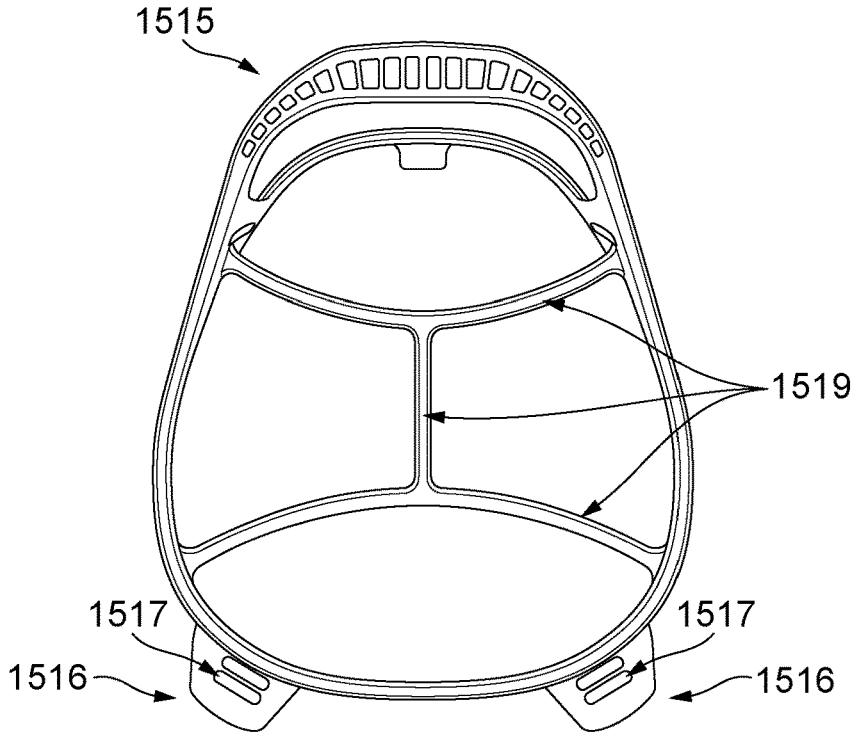
FIGS. 16A and 16B schematically illustrate another exemplary top cuff for a golf bag, in accordance with some embodiments.
Figure 16B:
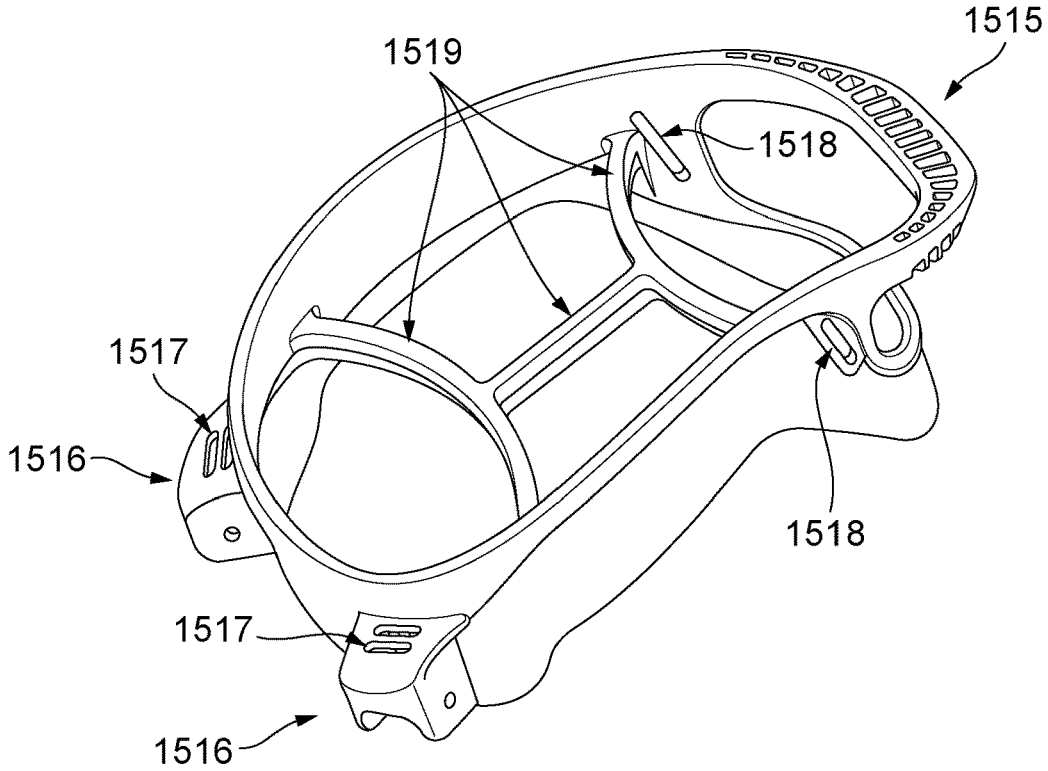

Referring now to FIGS. 16A and 16B, in some embodiments, the golf bag may comprise a top cuff 1515 arranged along the top opening of the golf bag. In some embodiments, the top cuff 1515 may comprise one or more dividers 1519 extending across the top opening of the golf bag to define one or more compartments for storing and/or holding golf equipment.

In some cases, the top cuff 1515 may comprise a handle portion that is integrally formed with the top cuff. In some cases, the handle portion may include one or more cut outs or slots extending vertically through the handle material to reduce the overall weight of the handle.

In some cases, the top cuff 1515 may comprise one or more connectors 1516 integrally formed with the top cuff. In some cases, the one or more connectors 1516 may be configured as leg knuckles that can receive and/or engage with one or more legs of the golf bag. In some cases, the one or more connectors 1516 may be used to pivotably couple the legs of the golf bag to the top cuff.

In some cases, the one or more connectors 1516 may comprise one or more slots 1517 provided along one or more surfaces of the one or more connectors to reduce the overall weight of the connectors. In some cases, the one or more slots 1517 may be configured to extend through an upper surface or a side surface of the one or more connectors.

In some cases, the top cuff may include one or more openings 1518 provided along one or more side surface portions of the top cuff. In some cases, the one or more openings 1518 may include one or more slots formed between a handle of the top cuff and a rear divider of the top cuff. In some cases, the one or more slots may be configured to extend through the one or more side surface portions of the top cuff.

In some cases, the golf bag may comprise one or more straps that can be inserted through the one or more slots. In some cases, the one or more straps may be wrapped around the top cuff and secured to the top cuff using one or more fasteners. In some cases, the one or more straps may comprise a first end that is secured to the top cuff and a second end with a fastener 1530 configured to engage one or more straps associated with a shoulder strap assembly of the golf bag. In some cases, the shoulder strap assembly may be connected to the fastener 1530 and one or more other fasteners 1531 provided on another portion or another component of the bag. In some cases, the one or more other fasteners 1531 may be provided on a rear body panel of the bag.

Top Cuff Wrap

Figure 17:
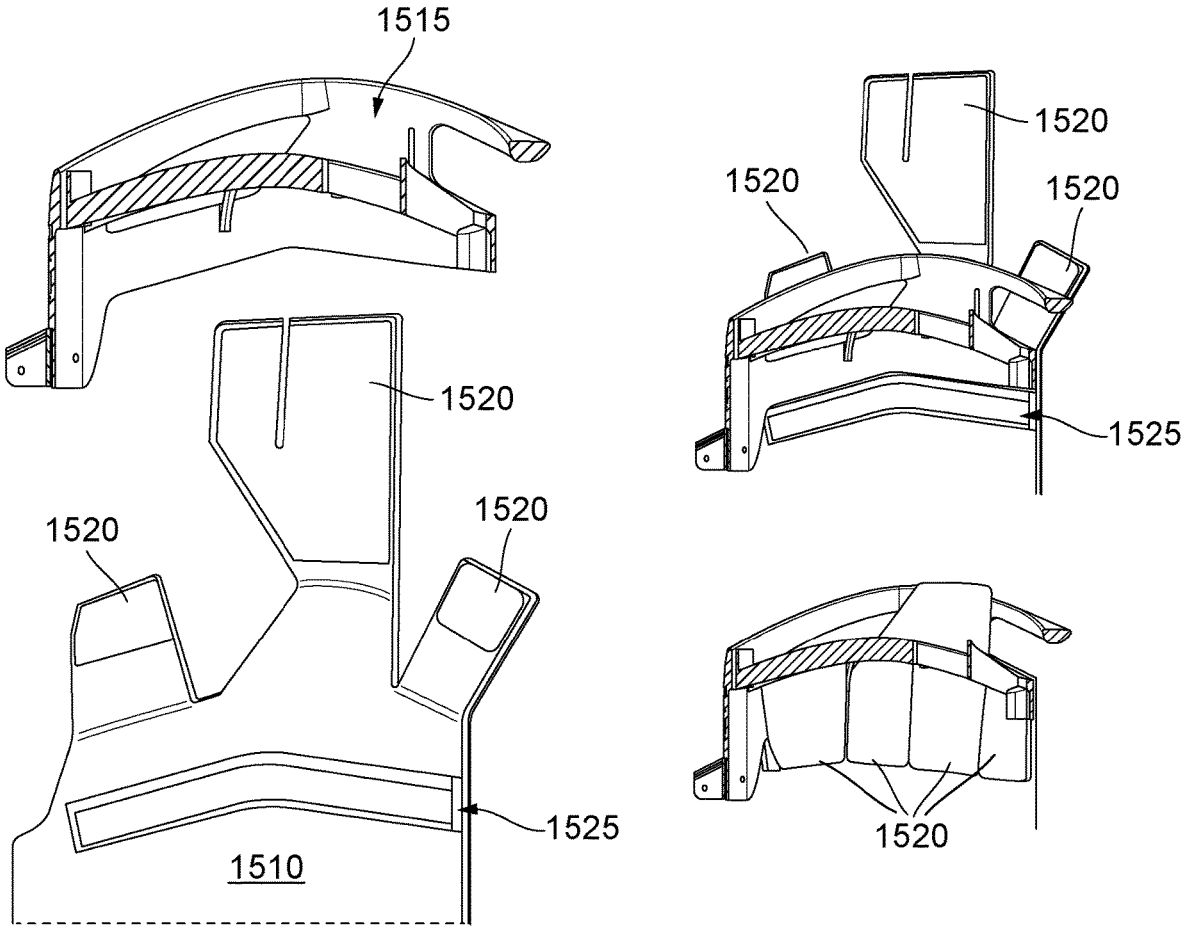
FIG. 17 schematically illustrates a liner that can be wrapped around or over a top cuff of the golf bags described herein, in accordance with some embodiments.

Referring now to FIG. 17, in some embodiments, the golf bag may include a liner 1520 that can be wrapped around or over the top cuff 1515 of the golf bag. In some cases, the liner 1520 may be configured to extend over a top wall or an upper edge of the top cuff 1515 of the golf bag. In some cases, the liner 1520 may include one or more flaps that can be folded over the top cuff 1515 and secured to an interior region of the golf bag. In some cases, the top cuff 1515 and the bag body may be attached or secured together when the flaps of the liner are secured to the interior region of the golf bag.

In some cases, a portion of the liner 1520 may be attached to an inner surface of the body panel 1510 of the golf bag. In some cases, a fastener may be attached to or integrated with a portion of the liner 1520. In some cases, the fastener may be used to attach a portion of the liner 1520 to the inner surface of the body panel 1510 of the golf bag. In some cases, the fastener may include one or more hook and/or loop fasteners. In some cases, one or more complementary fasteners may be attached to or provided on the inner surface of the body panel 1510. In some cases, the fastener may be configured to engage or interlock with the one or more complementary fasteners to secure a portion of the liner 1520 to the inner surface of the body panel 1510.

In some cases, the one or more complementary fasteners may be attached to or provided on one or more reinforcement strips 1525 extending along the inner surface of the body panel 1510. In some cases, the one or more reinforcement strips may include a polyethylene material. In some cases, the one or more reinforcement strips 1525 may be attached or seamed to the inner surface of the body panel (e.g., using an adhesive or one or more stitches). In some cases, the one or more reinforcement strips 1525 may be positioned below or underneath a bottom or lower edge of the top cuff.

Figure 18:
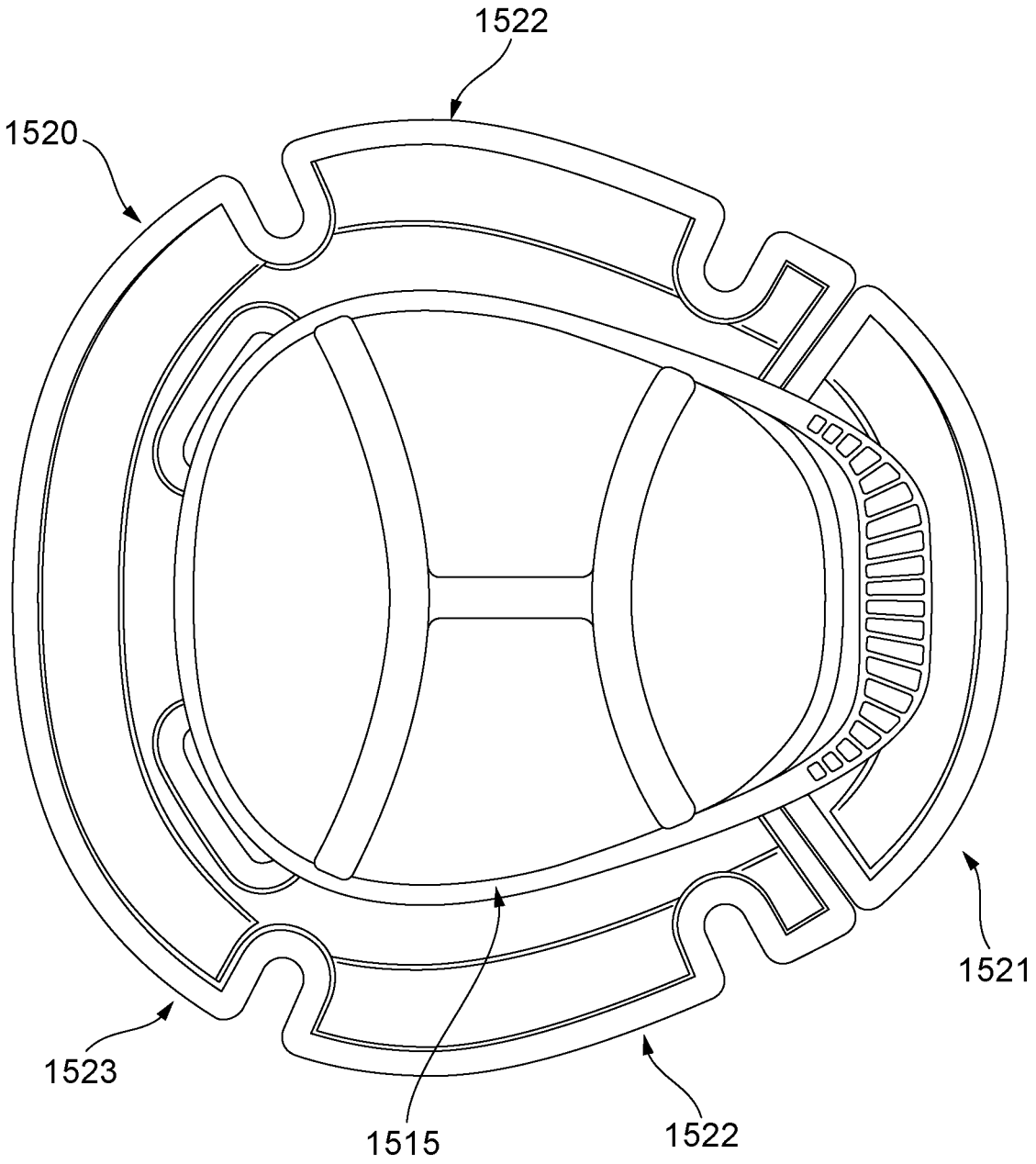
FIG. 18 schematically illustrates a top perspective view of a golf bag with a top cuff and a liner that can be wrapped around or over the top cuff, in accordance with some embodiments.

FIG. 18 illustrates a top perspective view of a top cuff 1515 for a lightweight golf bag. In some embodiments, a liner 1520 may be wrapped around and over an upper edge of the top cuff 1515. In some embodiments, a first portion of the liner 1521 may be configured to extend around and over a first portion of the top cuff. In some embodiments, a second portion of the liner 1522 may be configured to extend around and over a second portion of the top cuff. In some embodiments, a third portion of the liner 1523 may be configured to extend around and over a third portion of the top cuff.

In some embodiments, the first portion of the liner 1521 may be configured to overlap the second portion of the liner 1522. In other embodiments, the second portion of the liner 1522 may be configured to overlap the first portion of the liner 1521. In some alternative embodiments, the first portion of the liner 1521 and the second portion of the liner 1522 may not or need not overlap. In some embodiments, the third portion of the liner 1523 may be configured to overlap the second portion of the liner 1522. In other embodiments, the third portion of the liner 1523 may not or need not overlap the second portion of the liner 1522.

In some embodiments, the first portion of the liner 1521 may be configured to extend around a part of the top cuff that is positioned under a handle portion of the top cuff. In some embodiments, the second portion of the liner 1522 may be configured to extend along, around, and over one or more side surface portions of the top cuff. In some cases, the one or more side surface portions of the top cuff may be disposed between a handle assembly and a leg assembly of the golf bag. In some embodiments, the third portion of the liner 1523 may be configured to extend around a part of the top cuff that is positioned above one or more leg knuckles positioned along the front surface of the top cuff.

EXAMPLES

Figure 19A:
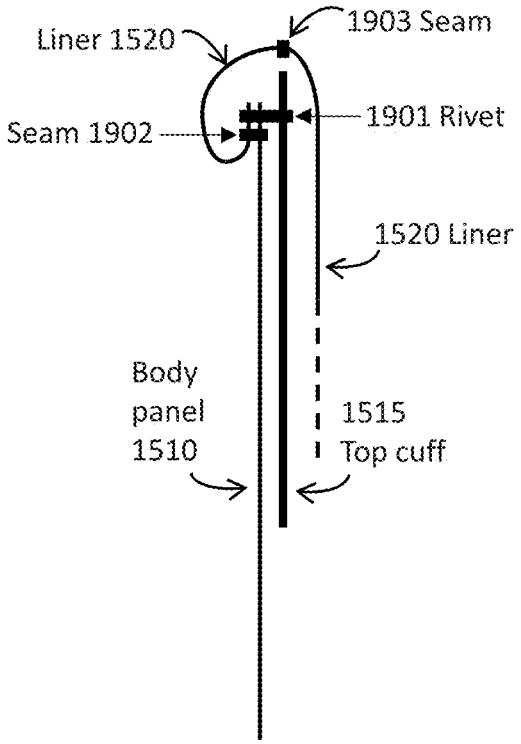
FIGS. 19A-19D schematically illustrate various different liner configurations that can conceal one or more fasteners used to couple the body panel(s) of the golf bag to the top cuff of the golf bag, in accordance with some embodiments.

FIG. 19A schematically illustrates one exemplary construction for a lightweight golf bag. In some embodiments, the golf bag may include a body panel 1510 attached to a top cuff 1515 of the golf bag. In some embodiments, the golf bag may include a liner 1520 that is attached or coupled to the body panel 1510 of the golf bag. In some cases, the liner 1520 may be wrapped around and over the top cuff 1515 of the golf bag.

In some cases, one or more rivets 1901 may be used to attach a portion or a section of the body panel 1510 to the top cuff 1515. In some cases, the one or more rivets may be configured to secure the body panel 1510 and/or the liner 1520 to the top cuff 1515. In some cases, the one or more rivets may be configured to secure the liner 1520 to the body panel 1510 and/or the top cuff 1515 of the golf bag. In some cases, the one or more rivets may be configured to secure the body panel 1510 to the liner 1520 and/or the top cuff 1515 of the golf bag. In some cases, the one or more rivets may be configured to extend through one or more seams connecting the body panel 1510 and the liner 1520 together.

In some cases, the body panel 1510 may include a first surface that is oriented towards the top cuff and a second surface that is oriented outwards and away from the top cuff. In some cases, the first surface of the body panel may correspond to an interior surface of the body panel. In some cases, the second surface of the body panel may correspond to an exterior surface of the body panel. In some cases, the interior surface of the body panel may be attached to an exterior surface of the top cuff of the golf bag. In some cases, the exterior surface of the body panel may be attached to an interior and/or exterior surface of a liner of the golf bag.

In some embodiments, the golf bag may include a liner 1520 that is extendable around and over the top cuff 1515. In some cases, the liner 1520 may comprise (i) a first edge attached to one or more body panels of the golf bag and (ii) a second edge that is securable (a) to an inner surface of the top cuff or (b) along an inner surface of the one or more body panels of the golf bag. In some cases, a portion of the liner 1520 may be folded over the one or more rivets 1901 used to attach the body panel 1510 of the golf bag to the top cuff 1515 of the golf bag, in order to cover or conceal the one or more rivets 1901 connecting the body panel 1510 and the top cuff 1515.

In some cases, the liner 1520 may have a first side and a second side opposite the first side. In some cases, at least a portion of the first side of the liner may correspond to an outer surface of the liner. In some cases, at least a portion of the second side of the liner may correspond to an inner surface of the liner.

In some cases, a select portion of the first side of the liner may be oriented towards the body panel 1510 and/or the exterior surface of the top cuff 1515. In some cases, a select portion of the first side of the liner may be configured to directly contact the exterior surface of the body panel 1510. In some cases, a select portion of the first side of the liner may be attached or coupled to the exterior surface of the body panel of the golf bag. In some cases, a select portion of the first side of the liner may be attached or coupled to the exterior surface of the body panel along a seam line 1902 that is adjacent or proximal to the first edge of the liner. In some cases, the seam line 1902 may be at least partially (i) covered or concealed by another portion or section of the liner or (ii) tucked behind or positioned under another portion or section of the liner.

In some cases, the first side of the liner may include one or more other portions extending from the first edge of the liner towards the top cuff. In some cases, the one or more other portions may be folded over the first edge of the liner so that the one or more other portions overlap the first edge of the liner. In some cases, the one or more other portions may be oriented outwards and/or away from the body panel 1510 and/or the top cuff 1515. In some cases, the one or more other portions may not or need not be in direct contact with the body panel 1510 and/or the top cuff 1515 of the golf bag.

In some cases, a remaining portion of the first side of the liner may be configured to extend from an upper edge of the top cuff towards an interior region of the body of the golf bag. In some cases, the remaining portion of the first side of the liner may be oriented away from one or more interior surfaces of the top cuff. In some cases, the remaining portion of the first side of the liner may not or need not directly contact any interior surfaces of the top cuff or the body panel.

In some cases, a select portion of the second side of the liner may be oriented away from the body panel 1510 and the top cuff 1515. In some cases, a select portion of the second side of the liner may be configured to face another interior or inner surface portion of the liner (e.g., when the liner is folded over itself to cover or conceal the rivets connecting the body panel and the top cuff). In some cases, a select portion of the second side of the liner may be configured to directly contact another interior or inner surface portion of the liner. In some cases, a select portion of the second side of the liner may not or need not directly contact an interior and/or exterior surface of the body panel 1510.

In some cases, the second side of the liner may include one or more other portions extending from the first edge of the liner towards the top cuff. In some cases, the one or more other portions may be folded over the first edge of the liner so that the one or more other portions overlap the first edge of the liner. In some cases, the one or more other portions may be folded over a select portion of the second side of the liner so that the select portion and the one or more other portions overlap and/or directly contact each other. In some cases, the one or more other portions of the second side of the liner may be folded over the first edge of the liner so that a first inner surface portion of the liner overlaps and/or contacts a second inner surface portion of the liner. In some cases, the one or more other portions may be oriented towards the body panel 1510 and/or the top cuff 1515. In some cases, the one or more other portions may not or need not be in direct contact with the body panel 1510 of the golf bag.

In some cases, a remaining portion of the second side of the liner may be configured to extend from an upper edge of the top cuff towards an interior region of the body of the golf bag. In some cases, the remaining portion of the second side of the liner may be oriented towards one or more interior surfaces of the top cuff or the body panel. In some cases, the remaining portion of the second side of the liner may overlap and/or directly contact one or more interior surfaces of the top cuff 1515 or the body panel 1510. In some cases, the remaining portion of the second side of the liner may overlap and/or directly contact one or more inner surfaces of the top cuff or the body panel.

In some embodiments, the liner 1520 may comprise a first liner piece and a second liner piece attached or coupled to the first liner piece along one or more seams 1903 to form the liner. In some cases, the one or more seams 1903 may be positioned along an upper edge of the top cuff when the liner is wrapped around/over the top cuff and the second edge portion of the liner is secured (a) to an inner surface of the top cuff or (b) along an inner surface of the body panel.

Figure 19B:
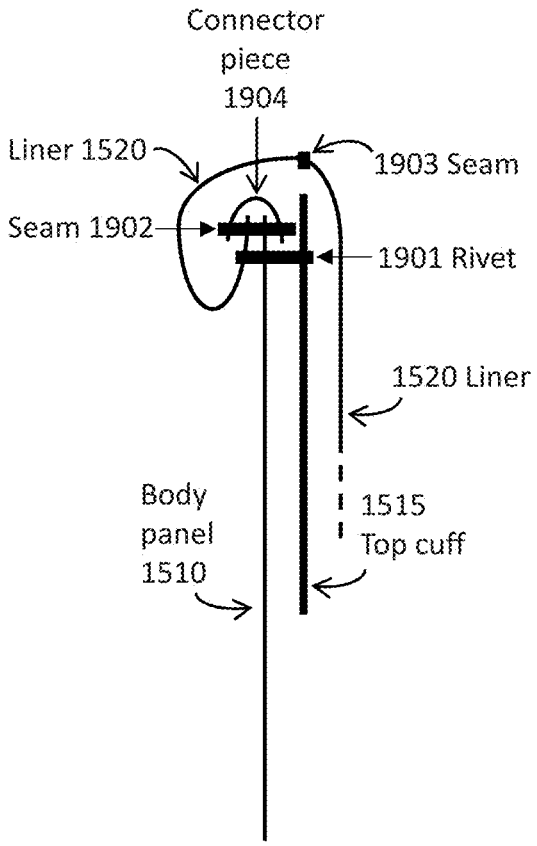

FIG. 19B schematically illustrates another exemplary construction for a lightweight golf bag. As described elsewhere herein, the golf bag may include a body panel 1510 attached to a top cuff 1515 of the golf bag. In some embodiments, the golf bag may include a liner 1520 that is attached or coupled to the body panel 1510 of the golf bag. In some cases, the liner 1520 may be wrapped around and over the top cuff 1515 of the golf bag.

In some cases, one or more rivets 1901 may be used to attach a portion or a section of the body panel 1510 to the top cuff 1515. In some cases, the one or more rivets may be configured to secure the body panel 1510 and/or the liner 1520 to the top cuff 1515. In some cases, the one or more rivets may be configured to secure the liner 1520 to the body panel 1510 and/or the top cuff 1515 of the golf bag. In some cases, the one or more rivets may be configured to secure the body panel 1510 to the liner 1520 and/or the top cuff 1515 of the golf bag. In some cases, the one or more rivets may be configured to extend through one or more seams connecting the body panel 1510 and the liner 1520 together.

In some cases, the body panel 1510 may include a first surface that is oriented towards the top cuff and a second surface that is oriented outwards and away from the top cuff. In some cases, the first surface of the body panel may correspond to an interior surface of the body panel. In some cases, the second surface of the body panel may correspond to an exterior surface of the body panel. In some cases, the interior surface of the body panel may be attached to an exterior surface of the top cuff of the golf bag. In some cases, the exterior surface of the body panel may be attached to an interior and/or exterior surface of a liner of the golf bag.

In some cases, the golf bag may comprise a liner 1520 that is extendable around and over the top cuff 1515. In some cases, the liner 1520 may comprise (i) a first edge attached to one or more body panels of the golf bag and (ii) a second edge that is securable (a) to an inner surface of the top cuff or (b) along an inner surface of the one or more body panels of the golf bag. In some cases, a portion of the liner 1520 may be folded over the one or more rivets 1901 used to attach the body panel 1510 of the golf bag to the top cuff 1515 of the golf bag, in order to cover or conceal the one or more rivets 1901 connecting the body panel 1510 and the top cuff 1515.

In some cases, the golf bag may include a connector piece 1904 configured to join the first edge of the liner 1520 to an upper edge of the body panel 1510. In some cases, the connector piece 1904 may comprise a first end positioned between two or more inner surface portions of the liner 1520 and a second end positioned between an interior surface of the body panel 1510 and an exterior surface of the top cuff 1515.

In some cases, the connector piece 1904, the liner 1520, and/or the body panel 1510 may be joined together using one or more seams. In some cases, the connector piece 1904, the liner 1520, and/or the body panel 1510 may be joined together along a seam line 1902 extending along or in close proximity to the first edge of the liner 1520 or the upper edge of the body panel 1510.

In some cases, a portion of the liner 1520 may be folded over the connector piece 1904 to cover or conceal the connector piece 1904. In some cases, a portion of the liner 1520 may be folded over the seam line 1902 in order to cover or conceal the one or more seams used to join the connector piece 1904, the liner 1520, and/or the body panel 1510 together. In some cases, when the liner 1520 is folded over the connector piece 1904, one or more inner surface portions of the liner may be configured to overlap the connector piece 1904. In some cases, when the liner 1520 is folded over the seam line 1902, one or more inner surface portions of the liner may be configured to overlap the seams joining the connector piece 1904, the liner 1520, and/or the body panel 1510 together.

In some cases, the liner 1520 may have a first side and a second side opposite the first side. In some cases, at least a portion of the first side of the liner may correspond to an outer surface of the liner. In some cases, at least a portion of the second side of the liner may correspond to an inner surface of the liner.

In some cases, a select portion of the first side of the liner may be oriented towards the body panel 1510 and/or an exterior surface of the top cuff 1515. In some cases, a select portion of the first side of the liner may be configured to directly contact an exterior surface of the body panel 1510. In some cases, a select portion of the first side of the liner may be attached or coupled to the exterior surface of the body panel of the golf bag. In some cases, a select portion of the first side of the liner may be attached or coupled to the exterior surface of the body panel along a seam line 1902 that is adjacent or proximal to the first edge of the liner. In some cases, the seam line 1902 may be at least partially (i) covered or concealed by another portion or section of the liner or (ii) tucked behind or positioned under another portion or section of the liner.

In some cases, the first side of the liner may include one or more other portions extending from the first edge of the liner towards the top cuff. In some cases, the one or more other portions may be folded over the first edge of the liner and the connector piece 1904 so that the one or more other portions overlap the first edge of the liner and the connector piece 1904. In some cases, the one or more other portions may be oriented outwards and/or away from the body panel 1510, the top cuff 1515, and/or the connector piece 1904. In some cases, the one or more other portions may not or need not directly contact the body panel 1510, the top cuff 1515, and/or the connector piece 1904.

In some cases, a remaining portion of the first side of the liner may be configured to extend from an upper edge of the top cuff towards an interior region of the body of the golf bag. In some cases, the remaining portion of the first side of the liner may be oriented away from one or more interior surfaces of the top cuff or the body panel. In some cases, the remaining portion of the first side of the liner may not or need not directly contact any interior surfaces of the top cuff or the body panel.

In some cases, a select portion of the second side of the liner may be oriented away from the body panel 1510 and the top cuff 1515. In some cases, a select portion of the second side of the liner may not or need not directly contact a surface of the body panel 1510 and/or the top cuff 1515. In some cases, a select portion of the second side of the liner may be configured to face another inner surface portion of the second side of the liner (e.g., when the liner is folded over itself to cover or conceal the seams or rivets connecting the body panel, the liner, and/or the top cuff together). In some cases, a select portion of the second side of the liner may be configured to face one or more inner surfaces of the connector piece 1904. In some cases, a select portion of the second side of the liner may be configured to directly contact one or more inner surface portions of the connector piece 1904.

In some cases, the second side of the liner may include one or more other portions extending from the first edge of the liner towards the top cuff. In some cases, the one or more other portions may be folded over the first edge of the liner so that the one or more other portions overlap the first edge of the liner. In some cases, the one or more other portions may be folded over the connector piece 1904 so that the one or more other portions overlap an outer surface of the connector piece 1904. In some cases, the one or more other portions may be folded over a select portion of the second side of the liner so that the select portion and the one or more other portions overlap and/or directly contact each other. In some cases, the one or more other portions of the second side of the liner may be folded over the first edge of the liner so that a first inner surface portion of the liner overlaps a second inner surface portion of the liner. In some cases, the one or more other portions may be oriented towards the body panel 1510 and/or the top cuff 1515. In some cases, the one or more other portions may not or need not be in direct contact with the body panel 1510 of the golf bag.

In some cases, a remaining portion of the second side of the liner may be configured to extend from an upper edge of the top cuff towards an interior region of the body of the golf bag. In some cases, the remaining portion of the second side of the liner may be oriented towards one or more interior surfaces of the top cuff or the body panel. In some cases, the remaining portion of the second side of the liner may overlap and/or directly contact one or more interior surfaces of the top cuff or the body panel. In some cases, the remaining portion of the second side of the liner may overlap and/or directly contact one or more inner surfaces of the top cuff or the body panel.

In some embodiments, the liner 1520 may comprise a first liner piece and a second liner piece attached or coupled to the first liner piece along one or more seams 1903 to form the liner. In some cases, the one or more seams 1903 may be positioned along an upper edge of the top cuff when the liner is wrapped around/over the top cuff and the second edge portion of the liner is secured (a) to an inner surface of the top cuff or (b) along an inner surface of the body panel.

Figure 19C:
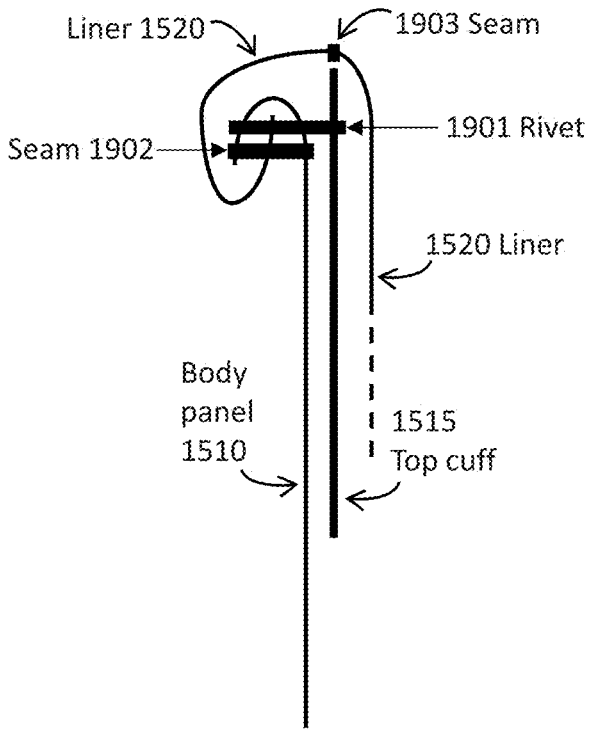

FIG. 19C schematically illustrates another exemplary construction for a lightweight golf bag. In some embodiments, the golf bag may include a body panel 1510 attached to a top cuff 1515 of the golf bag. In some embodiments, the golf bag may include a liner 1520 that is attached or coupled to the body panel 1510 of the golf bag. In some cases, the liner 1520 may be wrapped around and over the top cuff 1515 of the golf bag.

In some cases, one or more rivets 1901 may be used to attach a portion or a section of the body panel 1510 to the top cuff 1515. In some cases, the one or more rivets may be configured to secure the body panel 1510 and/or the liner 1520 to the top cuff 1515. In some cases, the one or more rivets may be configured to secure the liner 1520 to the body panel 1510 and/or the top cuff 1515 of the golf bag. In some cases, the one or more rivets may be configured to secure the body panel 1510 to the liner 1520 and/or the top cuff 1515 of the golf bag. In some cases, the one or more rivets may be configured to extend through one or more seams connecting the body panel 1510 and the liner 1520 together.

In some cases, the body panel 1510 may include a first surface that is oriented towards the top cuff and a second surface that is oriented outwards and away from the top cuff. In some cases, the first surface of the body panel may correspond to an interior surface of the body panel. In some cases, the second surface of the body panel may correspond to an exterior surface of the body panel. In some cases, the interior surface of the body panel may be attached to an exterior surface of the top cuff of the golf bag. In some cases, the exterior surface of the body panel may be attached to an interior surface and/or an exterior surface of a liner 1520 of the golf bag.

In some cases, the upper edge of the body panel 1510 may be folded outwards and away from the top cuff 1515 to form a folded end portion. In some cases, the upper edge of the body panel may be folded over the first edge of the liner 1520 so that the first edge of the liner is positioned between two or more exterior surface portions of the body panel 1510. In some cases, the upper edge of the body panel may be positioned between two or more inner surface portions of the liner 1520 when the upper edge of the body panel is folded over the first edge of the liner 1520. In some cases, the folded end portion of the body panel may be configured to position a first exterior surface portion of the body panel alongside or in close proximity to a second exterior surface portion of the body panel. In some cases, the first exterior surface portion of the body panel may overlap an outer or exterior surface portion of a liner 1520 of the golf bag. In some cases, the second exterior surface portion of the body panel may overlap an inner or interior surface portion of the liner 1520 of the golf bag. In some cases, an inner surface and/or an outer surface of the liner 1520 may be attached to at least one of the two or more exterior surface portions of the body panel.

In some cases, an edge portion of the liner 1520 may be positionable between the first and second exterior surface portions of the body panel 1510. In some cases, an edge portion of the liner 1520 may be attached or coupled to the folded end portion of the body panel 1510 using one or more seams. In some cases, the edge portion of the liner 1520 may be attached or coupled to the folded end portion of the body panel 1510 along a seam line 1902 that is adjacent or proximal to the first edge of the liner 1520 and/or an upper edge of the body panel 1510.

In some cases, the golf bag may comprise a liner 1520 that is extendable around and over the top cuff 1515. In some cases, the liner 1520 may comprise (i) a first edge attached to one or more body panels of the golf bag and (ii) a second edge that is securable (a) to an inner surface of the top cuff or (b) along an inner surface of the one or more body panels of the golf bag. In some cases, a portion of the liner 1520 may be folded over the one or more rivets 1901 used to attach the body panel 1510 of the golf bag to the top cuff 1515 of the golf bag, in order to cover or conceal the one or more rivets 1901 connecting the body panel 1510 and the top cuff 1515.

In some cases, a portion of the liner 1520 may be folded over the folded end portion of the body panel 1510 to cover or conceal the folded end portion of the body panel. In some cases, a portion of the liner 1520 may be folded over the seam line 1902 in order to cover or conceal the one or more seams used to join the first edge of the liner 1520 and the folded end portion of the body panel 1510 together. In some cases, when the liner 1520 is folded over the folded end portion of the body panel 1510, one or more inner surface portions of the liner may be configured to overlap (i) the folded end portion of the body panel and (ii) an inner surface portion of the body panel. In some cases, when the liner 1520 is folded over the seam line 1902, one or more inner surface portions of the liner may be configured to overlap the seam(s) joining the first edge of the liner 1520 and the folded end portion of the body panel 1510.

In some cases, the liner 1520 may have a first side and a second side opposite the first side. In some cases, at least a portion of the first side of the liner may correspond to an outer surface of the liner. In some cases, at least a portion of the second side of the liner may correspond to an inner surface of the liner.

In some cases, a select portion of the first side of the liner may be oriented towards the body panel 1510 and/or an exterior surface of the top cuff 1515. In some cases, a select portion of the first side of the liner may be configured to directly contact one or more exterior surfaces of the body panel 1510. In some cases, a select portion of the first side of the liner may be attached or coupled to one or more exterior surfaces of the body panel of the golf bag. In some cases, a select portion of the first side of the liner may be attached or coupled to an exterior surface of the body panel along a seam line 1902 that is adjacent or proximal to the first edge of the liner. In some cases, the seam line 1902 may be at least partially (i) covered or concealed by another portion or section of the liner or (ii) tucked behind or positioned under another portion or section of the liner.

In some cases, the first side of the liner may include one or more other portions extending from the first edge of the liner towards the top cuff. In some cases, the one or more other portions may be folded over the first edge of the liner and the folded end portion of the body panel so that the one or more other portions overlap the first edge of the liner and the folded end portion of the body panel. In some cases, the one or more other portions may be oriented outwards and/or away from the body panel 1510, the top cuff 1515, and/or the folded end portion of the body panel. In some cases, the one or more other portions may not or need not directly contact the body panel 1510, the top cuff 1515, and/or the folded end portion of the body panel 1510.

In some cases, a remaining portion of the first side of the liner may be configured to extend from an upper edge of the top cuff towards an interior region of the body of the golf bag. In some cases, the remaining portion of the first side of the liner may be oriented away from one or more interior surfaces of the top cuff or the body panel. In some cases, the remaining portion of the first side of the liner may not or need not directly contact any interior surfaces of the top cuff or the body panel.

In some cases, a select portion of the second side of the liner may be oriented away from the body panel 1510 and the top cuff 1515. In some cases, a select portion of the second side of the liner may be configured to face another portion of the second side of the liner (e.g., when the liner is folded over itself to cover or conceal the rivets or seams connecting the body panel, the liner, and/or the top cuff). In some cases, a select portion of the second side of the liner may be configured to face one or more outer or exterior surface portions of the body panel. In some cases, a select portion of the second side of the liner may be configured to directly contact one or more outer or exterior surface portions of the body panel. In some cases, the one or more outer or exterior surface portions of the body panel may form at least a part of the folded end portion of the body panel.

In some cases, the second side of the liner may include one or more other portions extending from the first edge of the liner towards the top cuff. In some cases, the one or more other portions may be folded over the folded end portion of the body panel so that the one or more other portions overlap the folded end portion of the body panel. In some cases, the one or more other portions may overlap and/or directly contact the folded end portion of the body panel 1510. In some cases, the one or more other portions may overlap and/or directly contact an interior or inner surface of the body panel 1510 when the liner 1520 is folded over the folded end portion of the body panel. In some cases, the one or more other portions may be oriented towards the folded end portion of the body panel 1510. In some cases, the one or more other portions may directly contact the folded end portion of the body panel 1510. In some cases, the one or more other portions may be oriented towards and/or may directly contact an interior or inner surface portion of the body panel when the liner 1520 is folded over the folded end portion of the body panel.

In some cases, a remaining portion of the second side of the liner may be configured to extend from an upper edge of the top cuff towards an interior region of the body of the golf bag. In some cases, the remaining portion of the second side of the liner may be oriented towards one or more interior surfaces of the top cuff or the body panel. In some cases, the remaining portion of the second side of the liner may overlap and/or directly contact one or more interior surfaces of the top cuff or the body panel. In some cases, the remaining portion of the second side of the liner may overlap and/or directly contact one or more inner surfaces of the top cuff or the body panel.

In some embodiments, the liner 1520 may comprise a first liner piece and a second liner piece attached or coupled to the first liner piece along one or more seams 1903 to form the liner. In some cases, the one or more seams 1903 may be positioned along an upper edge of the top cuff when the liner is wrapped around/over the top cuff and the second edge portion of the liner is secured (a) to an inner surface of the top cuff or (b) along an inner surface of the body panel.

Figure 19D:
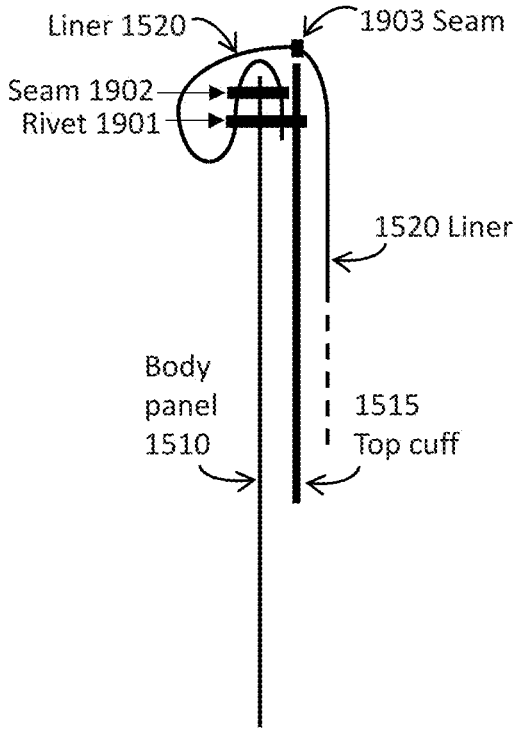

FIG. 19D schematically illustrates another exemplary construction for a lightweight golf bag. In some embodiments, the golf bag may include a body panel 1510 attached to a top cuff 1515 of the golf bag, as described elsewhere herein. In some embodiments, the golf bag may include a liner 1520 that is attached or coupled to the body panel 1510 of the golf bag. In some cases, the liner 1520 may be wrapped around and over the top cuff 1515 of the golf bag.

In some cases, one or more rivets 1901 may be used to attach a portion or a section of the body panel 1510 to the top cuff 1515. In some cases, the one or more rivets may be configured to secure the body panel 1510 and/or the liner 1520 to the top cuff 1515. In some cases, the one or more rivets may be configured to secure the liner 1520 to the body panel 1510 and/or the top cuff 1515 of the golf bag. In some cases, the one or more rivets may be configured to secure the body panel 1510 to the liner 1520 and/or the top cuff 1515 of the golf bag. In some cases, the one or more rivets may be configured to extend through one or more seams connecting the body panel 1510 and the liner 1520 together.

In some cases, the body panel 1510 may include a first surface that is oriented towards the top cuff and a second surface that is oriented outwards and away from the top cuff. In some cases, the first surface of the body panel may correspond to an interior or inner surface of the body panel. In some cases, the second surface of the body panel may correspond to an exterior or outer surface of the body panel. In some cases, the interior or inner surface of the body panel 1510 may be attached to an exterior or outer surface of the top cuff of the golf bag. In some cases, a portion of the interior or inner surface of the body panel 1510 may be attached to an exterior or outer surface of a liner 1520 of the golf bag. In some cases, a portion of the exterior or outer surface of the body panel 1510 may be attached to another exterior or outer surface of a liner 1520 of the golf bag.

In some cases, the golf bag may comprise a liner 1520 that is extendable around and over the top cuff 1515. In some cases, the liner 1520 may comprise (i) a first edge attached to one or more body panels of the golf bag and (ii) a second edge that is securable (a) to an inner surface of the top cuff or (b) along an inner surface of the one or more body panels of the golf bag. In some cases, a portion of the liner 1520 may be folded over the one or more rivets 1901 used to attach the body panel 1510 of the golf bag to the liner 1520 and/or the top cuff 1515 of the golf bag, in order to cover or conceal the one or more rivets 1901 connecting the body panel 1510, the liner 1520, and/or the top cuff 1515.

In some cases, the first edge of the liner 1520 may be folded over or around an upper edge of the body panel 1510 to form a folded end portion. In some cases, the first edge of the liner 1520 may be folded over an upper edge of the one or more body panels so that the upper edge of the one or more body panels is positioned between two or more outer surface portions of the liner. In some cases, the first edge of the liner 1520 may be positioned between an exterior or outer surface of the top cuff and an interior or inner surface of the body panel when the first edge of the liner 1520 is folded over or around the upper edge of the body panel. In some cases, the folded end portion of the liner may be configured to position a first exterior surface portion of the liner alongside or in close proximity to an interior or inner surface portion of the body panel. In some cases, the folded end portion may be configured to position a second exterior surface portion of the liner alongside or in close proximity to an exterior or outer surface portion of the body panel. In some cases, the body panel 1510 may be positioned between the first and second exterior surface portions of the liner. In some cases, an upper edge portion of the body panel 1510 may be positionable between the first and second exterior surface portions of the liner 1520. In some cases, an interior surface and/or an exterior surface of the body panel 1510 may be attached to at least one outer surface portion of the liner 1520.

In some cases, the folded end portion of the liner 1520 may be attached or coupled to the body panel 1510 using one or more seams. In some cases, the folded end portion of the liner 1520 may be attached or coupled to the upper edge of the body panel 1510 along a seam line 1902 that is adjacent or proximal to the first edge of the liner 1520 and/or the upper edge of the body panel 1510.

In some cases, a portion of the liner 1520 may be folded over the folded end portion of the liner 1520 to cover or conceal the folded end portion of the liner. In such cases, the folded end portion of the liner may be positioned between an exterior or outer surface of the top cuff and one or more interior or inner surfaces of the liner. In some cases, a portion of the liner 1520 may be folded around or over the first edge of the lining and/or the upper edge of the body panel 1510. In some cases, a portion of the liner 1520 may be folded over the seam line 1902 in order to cover or conceal the one or more seams used to join the folded end portion of the liner 1520 and the upper edge of the body panel 1510 together. In some cases, when the liner 1520 is folded over the folded end portion of the liner 1520, one or more inner surface portions of the liner may be configured to overlap (i) the folded end portion of the liner and (ii) one or more other inner surface portions of the liner. In some cases, when the liner 1520 is folded over the seam line 1902, one or more inner surface portions of the liner may be configured to overlap the seam(s) joining the first edge of the liner 1520 and the upper edge of the body panel 1510.

In some cases, the liner 1520 may have a first side and a second side opposite the first side. In some cases, at least a portion of the first side of the liner may correspond to an outer or exterior facing surface of the liner. In some cases, at least a portion of the second side of the liner may correspond to an inner or interior facing surface of the liner.

In some cases, a select portion of the first side of the liner may be oriented towards an exterior surface and/or an interior surface of the body panel 1510. In some cases, a select portion of the first side of the liner may be configured to directly contact one or more interior and/or exterior surfaces of the body panel 1510. In some cases, a select portion of the first side of the liner may be configured to directly contact both an interior and an exterior surface of the body panel. In some cases, one or more select portions of the first side of the liner may be attached or coupled to one or more interior and/or exterior surfaces of the body panel. In some cases, one or more select portions of the first side of the liner may be attached or coupled to an interior surface and/or an exterior surface of the body panel along a seam line 1902 that is adjacent or proximal to the first edge of the liner. In some cases, the seam line 1902 may be at least partially (i) covered or concealed by another portion or section of the liner or (ii) tucked behind or positioned under another portion or section of the liner.

In some cases, the first side of the liner may include one or more other portions extending from the first edge of the liner towards the top cuff. In some cases, the one or more other portions may be folded over a folded end portion of the liner so that the one or more other portions overlap the folded end portion of the liner and the upper edge of the body panel. In some cases, the one or more other portions may be oriented outwards and/or away from the body panel 1510 and the folded end portion of the liner. In some cases, the one or more other portions may not or need not directly contact the body panel 1510 or the folded end portion of the liner.

In some cases, a remaining portion of the first side of the liner may be configured to extend from an upper edge of the top cuff towards an interior region of the body of the golf bag. In some cases, the remaining portion of the first side of the liner may be oriented away from one or more interior surfaces of the top cuff or the body panel. In some cases, the remaining portion of the first side of the liner may not or need not directly contact any interior surfaces of the top cuff or the body panel.

In some cases, a select portion of the second side of the liner may be oriented away from the body panel 1510. In some cases, a first select portion of the second side of the liner may be oriented towards an exterior or outer surface of the top cuff 1515. In some cases, a second select portion of the second side of the liner may be configured to face another inner surface portion of the second side of the liner (e.g., when the liner is folded over itself to cover or conceal the rivets and/or seams connecting the liner, the body panel, and/or the top cuff). In some cases, a first select portion of the second side of the liner may be configured to face away from one or more inner or interior surface portions of the body panel. In some cases, a second select portion of the second side of the liner may be configured to face away from one or more outer or exterior surface portions of the body panel. In some cases, a first select portion of the second side of the liner may be configured to directly contact one or more outer or exterior surface portions of the top cuff. In some cases, a second select portion of the second side of the liner may be configured to directly contact one or more other inner or interior surface portions of the liner.

In some cases, the second side of the liner may include one or more other portions extending from the first edge of the liner towards the top cuff. In some cases, the one or more other portions may be folded over the folded end portion of the liner so that the one or more other portions overlap the folded end portion of the liner. In some cases, the one or more other portions may overlap the folded end portion of the liner and the upper edge of the body panel. In some cases, the one or more other portions of the second side of the liner may be folded over the folded end portion of the liner so that a first inner surface portion of the liner overlaps a second inner surface portion of the liner. In some cases, the one or more other portions may be oriented towards the body panel 1510, the top cuff 1515, and/or the folded end portion of the liner when the liner is folded over the folded end portion of the liner. In some cases, the one or more other portions may directly contact the folded end portion of the liner and/or an inner surface portion of the liner when the liner is folded over the folded end portion of the liner. In some cases, the one or more other portions may not or need not directly contact the body panel 1510 of the golf bag when the liner is folded over the folded end portion of the liner.

In some cases, a remaining portion of the second side of the liner may be configured to extend from an upper edge of the top cuff towards an interior region of the body of the golf bag. In some cases, the remaining portion of the second side of the liner may be oriented towards one or more interior surfaces of the top cuff or the body panel. In some cases, the remaining portion of the second side of the liner may overlap and/or directly contact one or more interior surfaces of the top cuff or the body panel. In some cases, the remaining portion of the second side of the liner may overlap and/or directly contact one or more interior or inner surfaces of the top cuff or the body panel.

In some embodiments, the liner 1520 may comprise a first liner piece and a second liner piece attached or coupled to the first liner piece along one or more seams 1903 to form the liner. In some cases, the one or more seams 1903 may be positioned along an upper edge of the top cuff when the liner is wrapped around/over the top cuff and the second edge portion of the liner is secured (a) to an inner surface of the top cuff or (b) along an inner surface of the body panel.

Hip Pad

Figure 20:
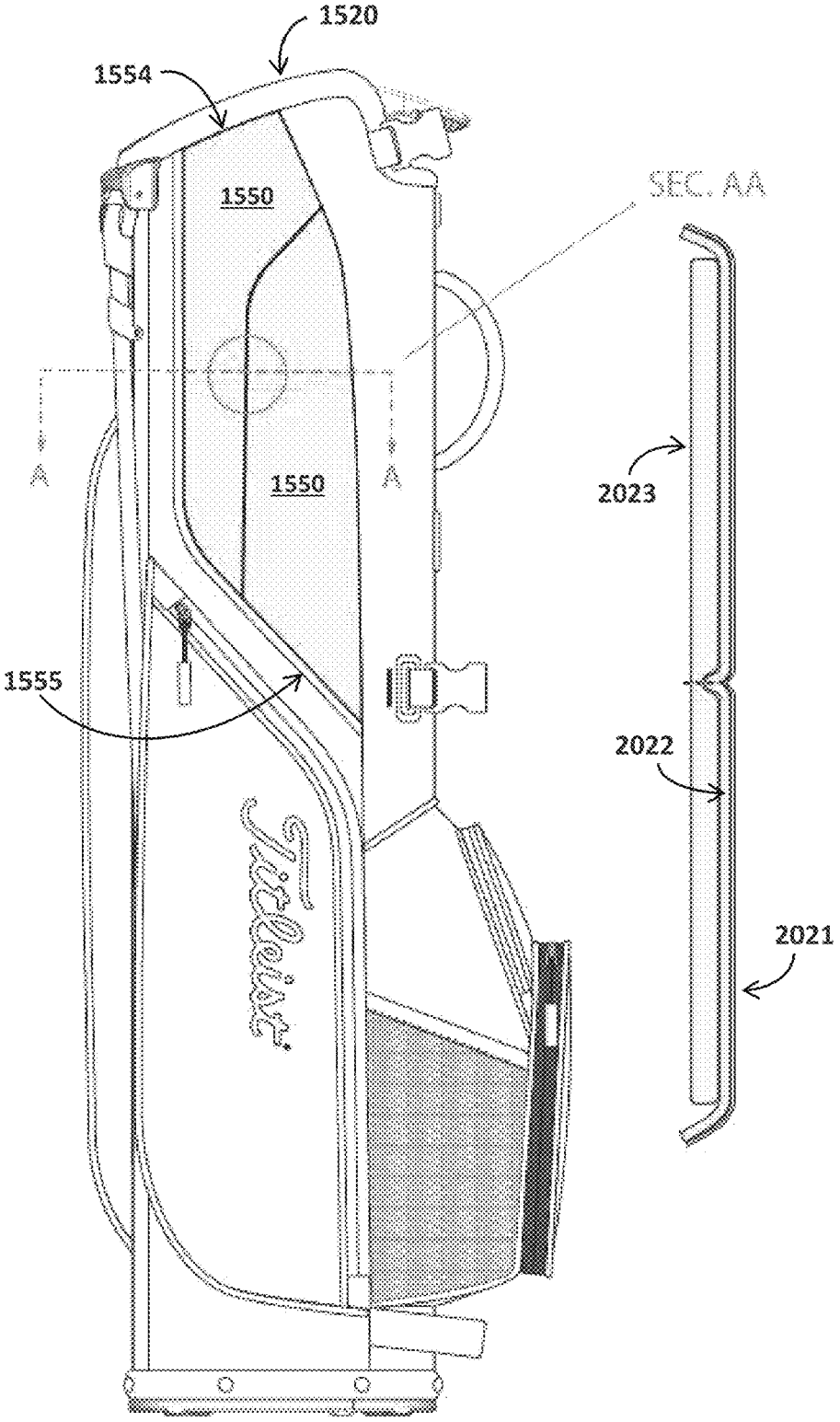
FIG. 20 schematically illustrates a hip pad that can be integrated with a body panel of the golf bags described herein, in accordance with some embodiments.

Referring now to FIG. 20, in some embodiments, the golf bag may comprise a hip pad 1550 configured to provide cushioning and/or support for any part of a subject's body which may come into contact with the bag body (e.g., when the golf bag is being handled or carried by the subject). In some cases, the golf bag may comprise a single hip pad. In some cases, the single hip pad may be configured to extend continuously from an upper edge 1554 of the one or more body panels to a lower edge 1555 of the hip pad 1550. In some cases, the lower edge 1555 of the hip pad may be configured to extend along or across a middle or central region of the golf bag. In some cases, the middle or central region may be positioned at or near a midpoint between the top opening and the bottom base of the golf bag. In some cases, the lower edge 1555 of the hip pad may extend parallel to an upper edge of a pocket provided underneath the hip pad.

In some cases, the hip pad 1550 may include one or more linear sides and/or one or more non-linear or curvilinear sides. In some cases, the hip pad 1550 may include one or more sides that gradually arc along a length of the body panel of the golf bag. In some cases, the one or more sides may have a gradual arc that coincides with and/or follows a piping seam on the body panel of the golf bag.

In some embodiments, the hip pad 1550 may comprise an outer layer 2021, a middle layer 2022 provided underneath the outer layer 2021, and an inner layer 2023 provided underneath the middle layer 2022. In some cases, the outer layer 2021 may be configured to extend over and cover the middle layer 2022 and the inner layer 2023. In some cases, the middle layer 2022 and the inner layer 2023 may be configured to provide cushioning and support when the hip pad contacts the subject's body.

In some cases, the outer layer 2021 may comprise a different material than the middle layer 2022 and/or the inner layer 2023. In some cases, the middle layer 2022 and the inner layer 2023 may comprise a same type of material. In other cases, the middle layer 2022 and the inner layer 2023 may comprise different materials.

In some cases, the outer layer 2021 may comprise a textile material. In some cases, the textile material may comprise a mesh material, a knit material, a woven material, a fabric material, a cloth material, or any other suitable material comprising one or more natural and/or synthetic threads or fibers.

In some embodiments, the middle layer 2022 may comprise a foam material with an open cell foam structure. In some embodiments, the foam material may comprise an open cell foam structure with one or more open or partially open cells.

In some embodiments, the inner layer 2023 may comprise a foam material with a closed cell foam structure. In some embodiments, the foam material may comprise a closed cell foam structure with one or more closed or partially closed cells.

In some embodiments, the middle layer 2022 and/or the inner layer 2023 may comprise an elastic foam. In some embodiments, the elastic foam may include, for example, ethylene vinyl acetate copolymer (EVA), an elasticized closed-cell foam with rubber-like softness and flexibility. In some embodiments, the middle layer 2022 and/or the inner layer 2023 may comprise a viscous foam. In some embodiments, the viscous foam may include, for example, a polyurethane foam or a polyethylene foam. In some alternate embodiments, the middle layer 2022 and/or the inner layer 2023 may comprise a viscoelastic foam. In some embodiments, the viscoelastic foam may have the elastic properties of an elastic foam and/or the viscous properties of a viscous foam. In some embodiments, the viscoelastic foam may comprise a memory foam or a memory foam-like material.

In some embodiments, the hip pad 1550 may comprise a single continuous hip pad with a height or a thickness. In some cases, the height or thickness may be uniform or substantially uniform across a length or a width of the hip pad. In other cases, the height or thickness may change or vary along the length or the width of the hip pad.

In some cases, the total height or the total thickness of the hip pad 1550 may correspond to a sum of the height or thickness of the outer layer 2021, the height or thickness of the middle layer 2022, and the height or thickness of the inner layer 2023. In some cases, the ratio of the height or thickness of the middle layer 2022 to the height or thickness of the inner layer 2023 may change or vary to provide the hip pad 1550 with multiple regions having different material properties. In some cases, the different material properties may include, for example, a different hardness or softness profile, a different level of cushioning, and/or a different compression profile under load.

In some cases, the outer layer 2021 may be attached to the middle layer 2022 and/or the inner layer 2023 using one or more stitches. In some cases, the one or more stitches may be arranged to provide a visual pattern (e.g., a tonal embroidered detail). In some cases, the one or more stitches may be configured to change or vary the total height of the hip pad 1550 in the hip pad regions containing the one or more stitches. In some cases, the hip pad regions containing the one or more stitches may have a different set of material properties than the other parts of the hip pad which may not or need not have any stitches.

Storage

In some embodiments, the golf bag may include one or more storage region for storing or holding personal items or sporting equipment. In some cases, the one or more storage regions may include an apparel pocket extending along a left or right side of the golf bag. In some cases, the one or more storage regions may include a valuables pocket integrated with or formed within the apparel pocket. In some cases, the valuables pocket may comprise a slip pocket with a folded edge extending across the width of the valuables pocket. In some cases, the slip pocket may be configured to hold one or more small personal items (e.g., a phone, a wallet, keys, etc.). In some cases, the one or more storage regions may include a saddle pocket provided on a right or left side of the golf bag opposite the apparel pocket. In some cases, the one or more storage regions may include a ball pocket provided along a back side of the golf bag. In some cases, the one or more storage regions may include a tee pocket positioned above the ball pocket. In some cases, the one or more storage regions may include a mesh sleeve formed along an external or exterior portion of the ball pocket.

Retention Clip

In some embodiments, the golf bag may include a retention clip 1535 configured to engage one or more wires connecting the legs of the golf bag to the bottom base of the golf bag. In some cases, the retention clip 1535 may be configured to control or manage an amount of tension in the wires when the legs are in an extended position or a retracted position. In some cases, the retention clip 1535 may be configured to control or manage an amount of force needed to move the legs between an extended position and a retracted position, or vice versa. In some cases, the retention clip 1535 may be configured to secure the wires and/or the legs of the bag in a position and/or an orientation that would allow the legs to remain in an extended position when the bag is set down on the ground. In some cases, the retention clip 1535 may be configured to secure the wires and/or the legs of the bag in a position and/or an orientation that would allow the legs to remain in a retracted position when the bag is picked up and carried by a subject. In some cases, the retention clip 1535 may be configured to secure the wires and/or the legs of the bag in a position and/or an orientation that would allow the legs to move between the extended position and the retracted position when a subject wants or needs to extend and/or retract the legs of the bag.

In some cases, the retention clip 1535 may comprise a plurality of channels configured to receive (i) a first wire connecting a first leg of the golf bag to the bottom base and (ii) a second wire connecting a second leg of the golf bag to the bottom base. In some cases, the plurality of channels may be formed within or through a body of the retention clip 1535. In some cases, the plurality of channels may be formed between two or more pieces or components that are securable to each other to form the body of the retention clip. In some cases, the two or more pieces or components may be secured together using one or more fasteners or adhesives. In other cases, the two or more pieces or components may be snap fit or press fit together without the use of any additional fasteners or adhesives.

All patents, publications, and references cited herein, including priority documents, are fully incorporated by reference. The materials, designs, constructions, structures, assemblies, sub-assemblies, and components described herein represent only some of the exemplary embodiments contemplated by the present disclosure. It is appreciated by those skilled in the art that variations can be made without departing from the spirit and scope of the present disclosure. Exemplary embodiments of the present disclosure are covered in the following claims.

What is claimed is:

1. A golf bag, comprising:

a bag body with a top opening, a closed bottom, and one or more body panels extending between the top opening and the closed bottom to form a partially enclosed region within the bag body for storing golf equipment;

a top cuff arranged along the top opening, the top cuff comprising (i) a lower member extending along one or more sides of the top cuff, (ii) an upper member extending above the lower member, the upper member forming an uppermost part of the top cuff, and (iii) a window or an aperture provided between the upper member and the lower member; and a lining that is extendable through the window or the aperture and around the lower member of the top cuff, wherein a portion of the lining is folded over the lower member of the top cuff and secured to an inner surface of the top cuff, wherein the one or more body panels comprise (i) a first portion that is directly secured to the inner surface of the top cuff and (ii) a second portion that is indirectly secured to the inner surface of the top cuff, wherein the second portion is configured to extend upwards along an outer surface of the top cuff, over the upper member of the top cuff, and back downwards along the inner surface of the top cuff.

2. The golf bag of claim 1, wherein the first portion is configured to extend through the window or the aperture.

3. The golf bag of claim 2, wherein the second portion is configured to extend around and over an upper edge of the top cuff.

4. The golf bag of claim 3, wherein the second portion is secured to the first portion.

5. The golf bag of claim 3, wherein the first portion is configured to indirectly secure the second portion to the inner surface of the top cuff.

6. The golf bag of claim 1, wherein the first portion and the second portion are configured to overlap a same portion of the inner surface of the top cuff.

7. The golf bag of claim 1, wherein the first portion and the second portion are configured to overlap different portions of the inner surface of the top cuff.

8. The golf bag of claim 1, wherein the first portion comprises a first set of extensions configured to extend around one or more dividers of the golf bag.

9. The golf bag of claim 8, wherein the second portion comprises a second set of extensions configured to extend around the one or more dividers of the golf bag.

10. The golf bag of claim 9, wherein the first set of extensions and the second set of extensions are configured to extend around a same divider of the golf bag.

11. The golf bag of claim 1, wherein the lining and the one or more body panels are secured along different portions of the inner surface of the top cuff.

12. The golf bag of claim 1, further comprising a separate front liner piece that is offset from an upper front side edge of the top cuff.

13. The golf bag of claim 12, wherein the top cuff comprises an inner wall that is spaced apart from the inner surface of the top cuff to form a channel slot.

14. The golf bag of claim 13, wherein the channel slot is configured to secure the separate front liner piece along a front portion of the inner surface of the top cuff.

15. The golf bag of claim 13, wherein the separate front liner piece is configured to extend over an upper edge of the inner wall and through a bottom of the channel slot.

16. The golf bag of claim 1, wherein the second portion is configured to extend around the top cuff without passing through the window or the aperture.

17. The golf bag of claim 1, wherein the first portion comprises a first side with a first fastener and a second side with a second fastener.

18. The golf bag of claim 17, wherein the first fastener is configured to engage the inner surface of the top cuff, and wherein the second fastener is configured to engage one or more other fasteners provided on the second portion.

19. The golf bag of claim 1, wherein the second portion comprises a first type of fastener configured to engage the first portion and a second type of fastener configured to engage the top cuff.

20. The golf bag of claim 19, wherein the second type of fastener comprises one or more integrated tabs that are insertable into a slot provided along the inner surface of the top cuff.

* * * * *